US007149461B2

(12) United States Patent
Tamura et al.

(10) Patent No.: US 7,149,461 B2
(45) **Date of Patent: *Dec. 12, 2006**

(54) IMAGE FORMING APPARATUS WITH MAGNETIC MEMBER IN FEEDING SUPPLY TUBE/SCREW ASSEMBLY

(75) Inventors: Masashige Tamura, Toride (JP); Makoto Kitahara, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/400,387

(22) Filed: Apr. 10, 2006

(65) Prior Publication Data

US 2006/0182470 A1 Aug. 17, 2006

Related U.S. Application Data

(62) Division of application No. 10/836,279, filed on May 3, 2004, now Pat. No. 7,050,744.

(30) Foreign Application Priority Data

May 2, 2003 (JP) ..... 2003-127480

(51) Int. Cl.
*G03G 15/08* (2006.01)

(52) U.S. Cl. ..... 399/258

(58) Field of Classification Search ..... 399/258, 399/263, 267, 359

See application file for complete search history.

(56) References Cited

U.S. PATENT DOCUMENTS

| | | | | |
|---|---|---|---|---|
| 3,983,841 | A | 10/1976 | Norton | 399/359 |
| 4,163,614 | A | 8/1979 | Vock | 399/258 |
| 4,442,789 | A | 4/1984 | Pirwitz | 399/258 |
| 6,597,881 | B1 | 7/2003 | Hatori et al. | 399/227 |
| 7,050,744 | B1 * | 5/2006 | Tamura et al. | 399/258 |
| 2002/0090230 | A1 | 7/2002 | Hatori et al. | 399/227 |

FOREIGN PATENT DOCUMENTS

| | | |
|---|---|---|
| JP | 56-114980 | 9/1981 |
| JP | 62-198880 | 9/1987 |
| JP | 8-328377 | 12/1996 |
| JP | 2000-10451 | 1/2000 |
| JP | 2002-214840 | 7/2002 |
| JP | 2002-214909 | 7/2002 |

* cited by examiner

*Primary Examiner*—Susan Lee
(74) *Attorney, Agent, or Firm*—Fitzpatrick, Cella, Harper & Scinto

(57) ABSTRACT

An image forming apparatus includes a developing device, a supply tube, a feeding screw and a magnetic member. The developing device develops an electrostatic image formed on an image bearing member with a magnetic developer. The supply tube supplies the magnetic developer into the developing device. The feeding screw feeds the magnetic developer in the supply tube. The magnetic member confines the magnetic developer in a clearance between the supply tube and the feeding screw. The magnetic member is provided at a substantially radially outermost portion of the feeding screw.

8 Claims, 17 Drawing Sheets

IMAGE FORMING APPARATUS WITH MAGNETIC MEMBER IN FEEDING SUPPLY TUBE/SCREW ASSEMBLY

This application is a divisional of U.S. patent application Ser. No. 10/836,279, filed May 3, 2004 now U.S. Pat. No. 7,050,744.

FIELD OF THE INVENTION AND RELATED ART

The present invention relates to an image forming apparatus such as a copying machine, a facsimile machine, a printer, etc., which employs an electrophotographic or electrostatic recording method.

Generally, a powder conveying apparatus has been structured to use a powder conveying means in the form of a screw as a means for controlling the amount by which powder is conveyed. The primary reason for the employment of a powder conveying means in the form of a screw (which hereinafter will be referred to as conveyance screw) is that the employment of a conveyance screw can make it easier to control the amount by which powder is conveyed, because the amount can be controlled by the number of times (angle) by which the conveyance screw is rotated; in other words, powder can be conveyed by a desired amount with the use of an inexpensive structure.

As for ordinary apparatuses which employ a powder conveying apparatus, there are electrophotographic image forming apparatuses and electrostatic image forming apparatuses. It has been a common practice to employ a conveyance screw as a means to convey developer in various portions of these image forming apparatuses.

As an example of a powder conveying apparatus employed by an electrophotographic image forming apparatus, there is a powder conveying apparatus for conveying developer from a developer hopper, that is, a container in which developer is temporarily held after being delivered thereto from a developer supply container, to a developing device which supplies developer to an electrophotographic photosensitive member, as an image bearing member, in the form of a drum, for example, to form a developer image (image formed of developer).

Regarding the design of such a developer conveying apparatus as the above described one, the developer conveyance passage of the developer conveying portion of the apparatus is structured so that developer is allowed to free fall in the gravity direction, into its final destination, or is horizontally conveyed toward its destination, at least at the end of its conveyance. It is in this horizontal portion of the developer conveyance passage that the aforementioned conveyance screw has been used.

There are various reasons for temporarily storing in a hopper the developer from a developer supply container. One of the reasons is that in recent years, toner as developer has been reduced in particle diameter to improve image quality. As has been known, the smaller in particle diameter the developer, the higher in fluidity the developer. Thus, in the case of the recent developer which is highly fluid because of its extremely small particle diameter, as the amount of the developer in the hopper reduces, the developer sometimes flows virtually in its entirety through the developer conveyance passage, like water, into the developing device, even though the conveyance screw is not being rotated. In other words, the so-called flushing sometimes occurs. This phenomenon occurs because the highly fluid developer is capable of flowing through the gap (clearance) between the internal surface of the developer conveyance passage in the form of a pipe, and the peripheral surface of the conveyance screw.

One of the preferable methods for preventing the occurrence of the flushing is to assure that the amount of the developer temporarily held in a hopper is large enough to keep the density of the developer in the adjacencies of the developer outlet, which is at the bottom of the hopper, high enough to counter the fluidity of the developer. In this case, a hopper is usually provided with a sensor for detecting developer amount, which is positioned in the hopper at a predetermined height, to detect the presence or absence of developer.

It is also a common practice to place the developer sensor slightly higher than the minimum height necessary to prevent the developer flushing, in order to provide a certain amount of margin between the detection of the developer absence and the forced stoppage of the image forming apparatus. This practice is for preventing a continuous image forming job from being interrupted. This positioning of the developer sensor definitely makes it necessary to increase hopper size. Nonetheless, this technology may be said to be mandatory for continuous formation of high quality images.

Another method for preventing the developer flushing is to tilt the above-mentioned developer conveyance portion of a developer conveying apparatus so that developer will be conveyed diagonally upward against gravity (diagonal hoist powder conveying apparatus). In recent years, the employment of this diagonal hoist type developer conveying apparatus has come to be commonly accepted, because in recent years, the demand has been increasing for an electrophotographic image forming apparatus, and the like, which are small in size, low in cost, and yet, high in image quality and productivity. A developer conveying system which employs a horizontal developer conveyance portion did not create any problem as long as it was possible to provide a large area for the placement of an image forming apparatus. However, with the development of the above described social background, it has become rather difficult to provide a space large enough for an image forming apparatus in accordance with the prior art, in which the developer supply container, hopper, and developing apparatus are positioned in this order listing from the top in terms of the horizontal direction. FIG. 12 shows an example of an electrophotographic image forming apparatus employing a diagonal hoist powder conveying apparatus as the developer conveying apparatus for conveying developer from the hopper 60 to the developing apparatus 103.

Other examples of an electrophotographic image forming apparatus in which a diagonal hoist powder conveying apparatus is usable are electrophotographic or electrostatic multicolor image forming apparatuses, in particular, those which employ a rotary type developing apparatus, which comprises a plurality of developing devices to be positioned opposite to the image bearing member(s) of the image forming apparatus to form a multicolor image (Japanese Laid-open Patent Application 8-328377, for example).

An image forming apparatus of this type, or an image forming apparatus employing a rotary developing apparatus, is structured so that the plurality of developing devices are supplied with two-component developer through developer conveyance pipes from the developer supply containers placed in the rotary. The developer conveyance pipes are provided with a conveyance screw.

This structure for an image forming apparatus employing a rotary developing apparatus has come to be widely used for the following reason. That is, in the case of an image forming apparatus in which developer supply containers are placed in the rotary, the process for supplying the developing devices with developer can be completed within the rotary, being therefore simpler in structure. In addition, the developer supplying process can be controlled simply by controlling the revolution of the developer conveyance screw of the developer conveying apparatus. Thus, the employment of this structural arrangement offers various advantages; for example, not only can it reduce apparatus cost, but also, the size of a multicolor image forming apparatus.

FIG. 15 shows an example of a rotary developing apparatus employed by an electrophotographic image forming apparatus. The rotary developing apparatus 201 in the drawing has four developing devices 203Y, 203M, 203C, and 203K, which are connected to developer supply containers 80Y, 80M, 80C, and 80K, with developer conveying apparatuses 70Y, 70M, 70C, and 70K interposed, respectively.

In order to prevent toner from agglomerating during conveyance, it is desired that a certain amount of clearance is provided between a conveyance screw and a conveyance pipe. If this clearance is no more than a certain value, it is possible that toner is forcefully rubbed by the conveyance screw and conveyance pipe due to such mechanical phenomena as the decentering, vibration, etc., of the conveyance screw, becoming thereby agglomerated.

An apparatus of this type also has the problem that when the conveyance pipes begin to be orbitally moved together with the developing devices by the rotation of the rotary for moving a specific developing device to the development station, or the movements thereof are stopped, developer accidentally flows (leaks) into the developing devices through the clearance between the conveyance screw and conveyance pipe. This accidental conveyance of toner into the developing devices possibly changes the toner contents of the developer in the developing devices, which results in the changes in image density.

As for a countermeasure for this problem, Japanese Laid-open Patent Applications 2002-214909 and 2002-214840 disclose a structural arrangement that magnets are disposed in the adjacencies of the peripheral surface of the conveyance pipe in order to seal between the conveyance screw and conveyance pipe by magnetically confining the developer in the aforementioned clearance with the magnetic fields from these magnets.

However, the structural arrangement disclosed in Japanese Laid-open Patent Applications 2002-214909 and 2002-214840 suffer from the following problems.

According to Japanese Laid-open Patent Applications 2002-214909 and 2002-214840, the magnets are attached to the peripheral surface of the conveyance pipe to magnetically seal the gap between the conveyance screw and conveyance pipe. Therefore, it is necessary to employ magnets having a large amount of magnetic force, making it possible for the magnetic force to interfere with the developer conveyance, that is, the primary function of the developer conveying apparatus.

To describe this interference in more detail, with the attachment of magnets to the peripheral surface of a conveyance pipe, the two-component developer is magnetically held in layers to the internal surface of a conveyance pipe by the magnetic field generated by the magnets on the peripheral surface of the conveyance pipe. Therefore, when developer is conveyed, as necessary, by the surface of the spiral flange of the conveyance screw, friction occurs between the developer which is being conveyed, and the developer held in layers to the internal surface of the conveyance pipe (frictional resistance of internal surface of conveyance pipe increases due to laminar adhesion of developer thereto by magnetic force). As a result, developer fails to be conveyed to a developing device by a desired amount.

Further, it is possible that the attempt to supply a developing device with a desired amount of developer despite the frictional resistance causes toner to agglomerate due to the friction between the two-component developer having been held to the internal surface of the conveyance pipe and the developer being conveyed through the conveyance pipe.

If the agglomerated toner, or coarse toner, is supplied to a developing device, it adversely affects the image formation thereafter, resulting in the formation of low quality images. Thus, the toner agglomeration must be avoided.

SUMMARY OF THE INVENTION

The primary object of the present invention is to provide an image forming apparatus in which developer does not accidentally flow (leak) through the clearance between the developer supply tube and the developer conveyance screw therein.

Another object of the present invention is to provide an image forming apparatus in which developer does not accidentally flow (leak) through the clearance between the developer supply tube and the developer conveyance screw therein, and which is superior in the developer conveyance to the developing device(s) by the developer conveyance screw.

Another object of the present invention is to provide an image forming apparatus in which developer does not accidentally flow (leak) through the clearance between the developer supply tube and the developer conveyance screw therein, even if shock occurs as the rotation of the rotary is stopped, and which is superior in the developer conveyance to the developing device(s) by the developer conveyance screw.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the powder conveying apparatus, rotary developing apparatus, and image forming apparatus, in accordance with the present invention, will be described in detail with reference to the appended drawings.

Embodiment 1

First, the first embodiment of a powder conveying apparatus in accordance with the present invention will be described. The powder conveying apparatus in this embodiment employs an auger as a powder conveying means. It is a preferable developer conveying apparatus for such an electrophotographic or electrostatic image forming apparatus as a copying machine, a facsimile machine, a printer, etc.

Figure 1:
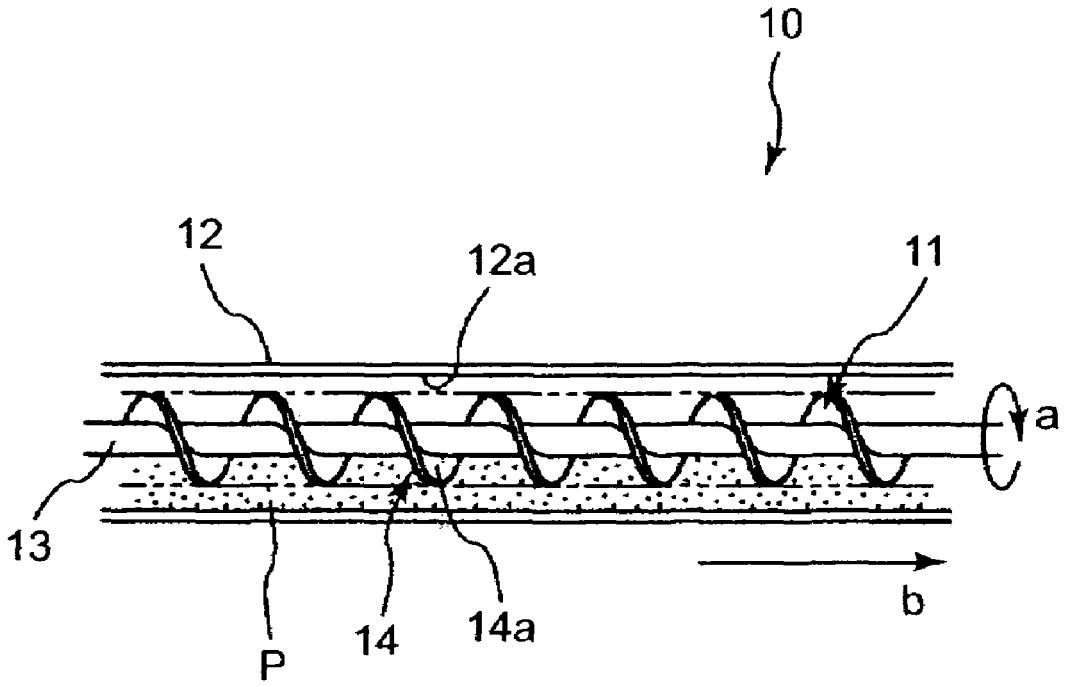
FIG. 1 is a schematic sectional view of an example of a powder conveying apparatus in the first embodiment of the present invention, showing the general structure of the essential portions thereof.

FIG. 1 is a schematic sectional view of the essential portion of the powder conveying apparatus 10 in this embodiment, showing the general structure thereof. As shown in the drawing, the powder conveying apparatus 10 has a powder conveying screw 11 (which hereinafter will be referred to as conveyance screw) as a powder conveying means. The conveyance screw 11 comprises a spiral flange 14 having a spiral conveyance surface 14a as the primary part for powder conveyance, and a rotational shaft 13 around which the spiral flange is spirally attached. The conveyance screw 11 is rotationally supported so that it will rotate roughly about the rotational axis of the rotational shaft 13.

The conveyance screw 11 is disposed within a roughly cylindrical pipe as the powder conveyance portion of the powder conveying apparatus 10, being supported so that it will rotate relative to the powder conveyance pipe 12 roughly about the axial line of the conveyance pipe 12. As the conveyance screw 11 is rotated in the direction indicated by an arrow mark a in the drawing, the powder P, as an object to be conveyed, within the conveyance pipe 12 is conveyed in the direction indicated by an arrow mark b by the spiral conveyance surface 14*a* of the spiral flange 14 of the conveyance screw 11.

The powder conveying apparatus 10 in this embodiment is provided with a magnetic field generating means 15, which is attached to the peripheral surface 14*b* of the spiral flange 14 of the conveyance screw 11. Next, referring to FIG. 2, the magnetic field generating means 15 is provided to seal the space between the internal surface 12*a* of the conveyance pipe 12 and the spiral flange 14 of the conveyance screw 11, with a body of magnetic powder M confined in the space by the magnetic force from the magnetic field generating means 15 attached to the peripheral surface 14*b* of the spiral flange 14.

The magnetic field generating means 15 is designed to seal the clearance between the peripheral surface (edge) 14*b* of the spiral flange 14 and the internal surface 12*a* of the conveyance pipe 12 by the body of magnetic powder M made to crest by the magnetic field generating means 15. The means for making the magnetic powder M crest does not need to be limited to the magnetic field generating means 15 in this embodiment; any available means may be employed as long as it is capable of making the magnetic powder M crest so that the clearance C1 between the peripheral surface 14*b* of the spiral flange 14, and the internal surface 12*a* of the conveyance pipe 12 (in this embodiment, gap between the surface of magnetic field generating means 15 placed in the groove of the peripheral surface 14*b* of spiral flange 14, and internal surface 12*a* of conveyance pipe 12) is sealed.

It is not mandatory that the magnetic field generating means 15 is such that causes the magnetic powder M to crest in a manner to continuously encircle the spiral flange 14 by a distance equivalent to one full rotation of the spiral flange 14, along the peripheral surface 14*b* of the spiral flange 14. In other words, the magnetic field generating means 15 may be such a means that generates a plurality of magnetic fields, virtually connected to each other, or separated from each other, in terms of the direction of the normal line of the spiral flange 14, so that the flux density repeatedly changes between the virtually zero level and maximum value, in terms of the direction of the normal line of the spiral flange 14.

In this embodiment, the magnetic field generating means 15 needs to be such that can be attached to the peripheral surface 14*b* of the spiral flange 14. As a magnetic field generating means compatible with the present invention, there are an elastic magnet in the form of a sheet of rubber or plastic which contains magnetic substance, a thin plate of metallic magnetic substance, etc. In this embodiment, a magnetic member (elastic magnetic member) 15 in the form of a belt cut out of a sheet of elastic magnet is employed in consideration of the ease with which it can be attached to the peripheral surface 14*b* of the spiral flange 14, ease with which it can be processed, stability in magnetic force, and the like properties. The elastic magnetic belt 15 is long enough to reach from one end of the peripheral surface 14*b* of the spiral flange 14 to the other, and is attached to the peripheral surface 14*b* of the spiral flange 14, being extended literally from one end of the peripheral surface 14*b* of the spiral flange 14 to the other.

The magnetic powder M seals the gap between the peripheral surface 14*b* of the spiral flange 14 and the internal surface 12*a* of the conveyance pipe 12 by being confined in the gap in a manner to crest in the gap, by the magnetic field generating means 15. The magnetic powder M for sealing the gap between the peripheral surface 14*b* and internal surface 12*a* may be any available magnetic powder as long as it is capable of being made to crest, by the magnetic field, in a manner to fill the clearance C1 between the peripheral surface 14*b* and internal surface 12*a*, and also, as long as it is compatible with the powder P to be conveyed.

However, the magnetic powder for sealing the gap between the peripheral surface 14*b* and internal surface 12*a* is desired to be stable in magnetic force, in consideration of the stability in sealing performance. As magnetic powder that satisfies the above described conditions, there are metallic powder, powder of resinous substance containing magnetic substance, etc. When the powder conveying apparatus 10 is employed as the magnetic developer conveying apparatus of an electrophotographic image forming apparatus, which conveys single-component developer (magnetic toner) as developer, it is desired that developer itself can be used as the magnetic powder M for sealing the aforementioned gap, because when developer itself can play the role of magnetic powder M, there is no chance that developer is contaminated by foreign substances. Further, when the powder conveying apparatus 10 is employed as the developer conveying apparatus of an electrophotographic image forming apparatus, for example, for conveying two-component developer which is essentially a mixture of nonmagnetic toner and magnetic carrier, it is desired that the magnetic carrier of the two-component developer can be used as the magnetic powder M, because when the magnetic carrier of the two-component developer can be used as the magnetic powder M, there is also no chance that developer is contaminated by foreign substances.

The ratio of the magnetic powder M in the developer needs to be large enough to make it possible for the magnetic powder M to keep sealed the space between the peripheral surface 14*b* of the spiral flange 14 and the internal surface 12*a* of the conveyance pipe 12 for a desired length of time. This ratio is dependent upon the size of the clearance C1 between the peripheral surface 14*b* of the spiral flange 14 and the internal surface 12*a* of the conveyance pipe 12, lengths of the conveyance pipe 12 and conveyance screw 11, properties of the magnetic powder M and magnetic field generating means 15, etc. Thus, the optimal ratio of the magnetic powder M should be determined as fit by the people in the field of this business, according to the disclosure in the specifications of the present invention, and the characteristics of the powder conveying apparatus 10, magnetic field generating means 15, and magnetic powder M, which are to be used.

Incidentally, as long as it is permissible in the usage of the powder conveying apparatus 10, it is beneficial to mix a minute amount of magnetic powder M into the powder P to be conveyed, because, with the mixing of a minute amount of magnetic powder M into the powder P to be conveyed, even if the body of magnetic powder M which is filling the clearance C1 between the peripheral surface 14*b* of the spiral flange 14 and internal surface 12*a* of the conveyance pipe 12 collapses due to the elapse of time, the conveyance pipe 12 is replenished with the magnetic powder M by the powder P to be conveyed, each time the powder P is conveyed. Obviously, when the powder P itself is magnetic, the results will be the same. When the powder conveying apparatus 10 is used as the developer conveying apparatus of, for example, an electrophotographic image forming apparatus, which uses such developer, as the powder P to be conveyed, containing magnetic carrier (automatic carrier replenishment mechanism), the clearance C1 is continuously supplied with this magnetic carrier as the magnetic powder M.

The conveyance screw 11 as a conveying means may be of any kind in accordance with the technical background in this field. In this embodiment, the conveyance screw 11 is molded of resinous substance, and in order to provide an optimal place to which the elastic magnetic belt 15 as the magnetic field generating means is to be pasted, the peripheral surface (edge) 14*b* of the spiral flange 14 is provided with a groove 14*c* with a rectangular cross-section.

Providing the peripheral surface 14*b* of the spiral flange 14 with the groove 14*c* as described above makes it easier to glue the elastic magnetic belt 15 to the spiral flange 14 with the use of adhesive as a fixing means, and also, to prevent the excess adhesive from spreading onto the powder conveying surface 14*a* of the spiral flange 14. For example, if the peripheral surface 14*b* of the spiral flange 14 is not provided with the groove 14*c*, the adhesive may actually leak out onto the powder conveying surface 14*a* of the spiral flange 14 when pasting the elastic magnetic belt 15 to the peripheral surface 14*b* of the spiral flange 14. Should adhesive actually leak, it adversely affects the level of precision at which the powder is conveyed, or product acceptance from the standpoint of quality control. Thus, it must be assured that there will be no leakage of the glue for adhering the elastic magnetic belt 15.

Figure 2:
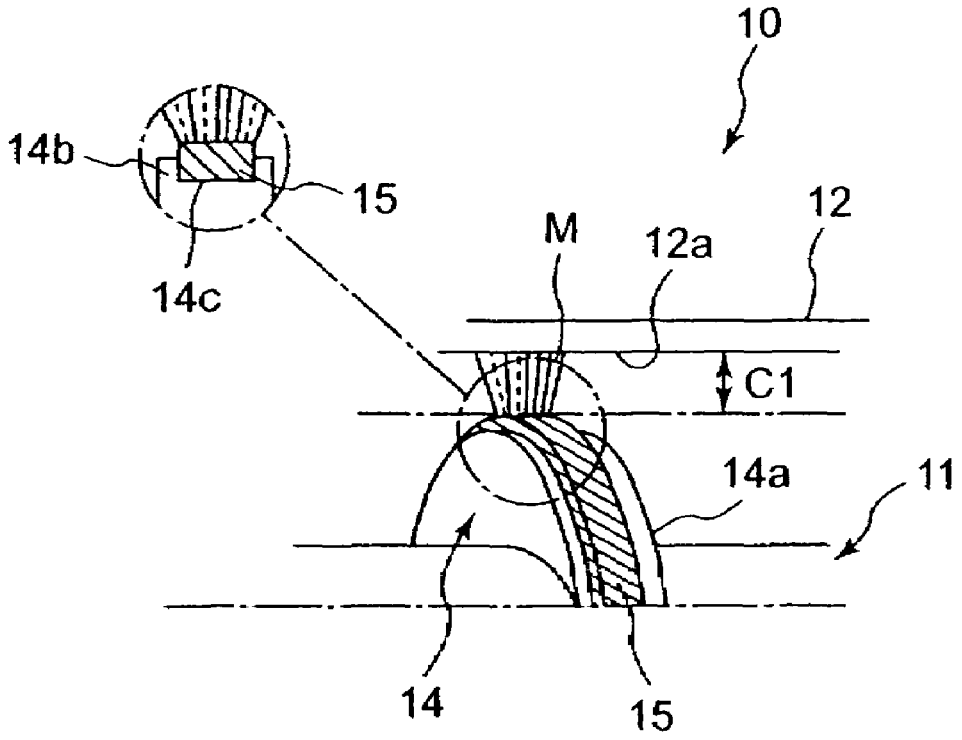
FIG. 2 is an enlarged view of the portion of the powder conveying apparatus, in FIG. 1, essential to the description of the present invention, showing in detail the relationship between the powder conveyance pipe and powder conveyance screw.

Further, placing the elastic magnetic belt 15 in the groove 14*c* allows only a part of the elastic magnetic belt 15 to be exposed. Therefore, a larger portion of the magnetic force from the elastic magnetic belt 15 is directed toward the space to be filled with the magnetic powder M as shown in FIG. 2; in other words, the placement enhances the effect of elastic magnetic belt 15. To describe in reverse, placing the elastic magnetic belt 15 in the groove 14*c* reduces the amount of the magnetic force which must be generated by the elastic magnetic belt 15, compared to when the peripheral surface 14*b* of the spiral flange 14 is not provided with the groove 14*c*, and therefore, the elastic magnetic belt 15 must be pasted to the groove-less flat peripheral surface 14*b* of the spiral flange 14. Further, placing the elastic magnetic belt 15 in the groove 14*c* is beneficial in that it reduces the clearance C1 between the internal surface 12*a* of the conveyance pipe 12 and the peripheral surface 14*b* of the spiral flange 14.

Figure 3:
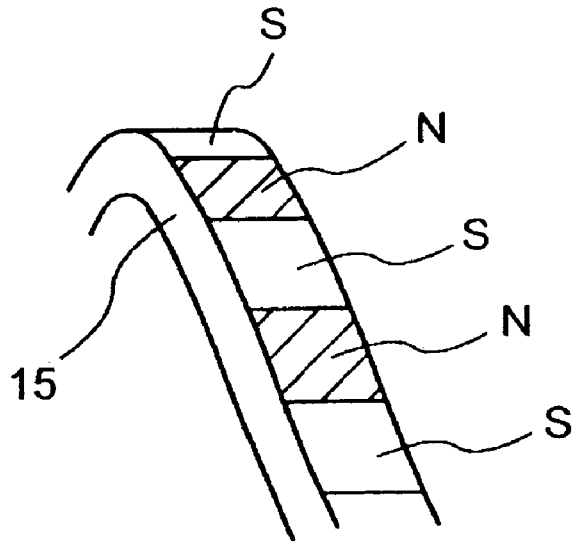
FIG. 3 is a perspective view of the essential portion of the elastic magnetic belt of the power conveying apparatus in FIG. 1, showing the positioning of the magnetic poles thereof.
Figure 4:
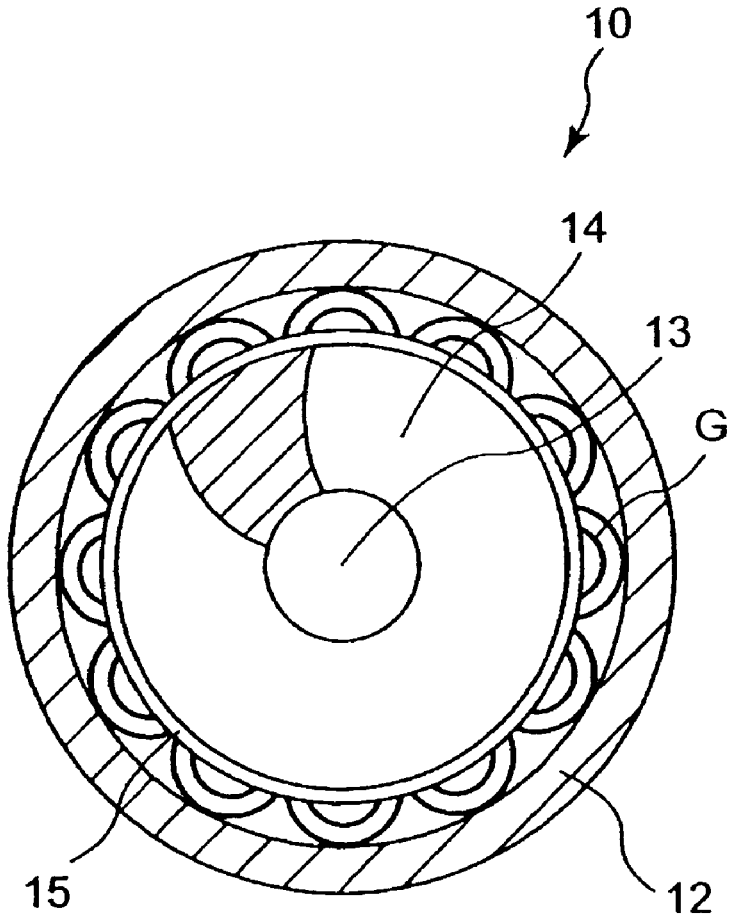
FIG. 4 is a schematic cross-sectional view of the powder conveying apparatus in FIG. 1, showing the state of the magnetic lines of flux generated by the elastic magnetic belt of the powder conveying apparatus.

FIG. 3 schematically shows the positioning of the magnetic poles of the elastic magnetic belt 15 in this embodiment, and FIG. 4 schematically shows the magnetic lines of force G when the magnetic poles are positioned as shown in FIG. 3. FIG. 4 is a schematic cross-sectional view of the powder conveying apparatus, at a plane perpendicular to the axial line of the conveyance screw 11.

In this embodiment, the elastic magnet 15 as the magnetic field generating means is in the form of a belt. The N poles and S poles of the elastic magnetic belt 15, which are given a predetermined length, are alternately positioned in the lengthwise direction of the elastic magnetic belt 15, so that they face the internal surface 12*a* of the conveyance pipe 12 as the elastic magnetic belt 15 is attached in the groove 14*c* of the peripheral surface 14*b* of the spiral flange 14.

In this embodiment, the elastic magnetic belt 15 is long enough to extend virtually from one end of the peripheral surface 14*b* of the spiral flange 14 to the other. However, it does not need to be a single piece belt; it may be made up of several shorter elastic magnetic belts of an optional length, which can be sequentially pasted in the groove 14*c* of the peripheral surface 14*b* of the spiral flange 14 in a manner to fill the groove 14*c* from one end to the other.

In consideration of mass-production, the magnetic poles of the elastic magnetic belt 15 are desired to be arranged so that the N and S poles are alternately positioned in terms of the lengthwise direction of the elastic magnetic belt 15 as described above. The reason for this arrangement is that if the N and S poles are arranged in the widthwise direction of the elastic magnetic belt 15, or the N and S poles are arranged so that the N poles are on one surface of the elastic magnetic belt 15 and the S poles are on the other surface, the cost of the elastic magnetic belt 15 may substantially increase.

Figure 5:
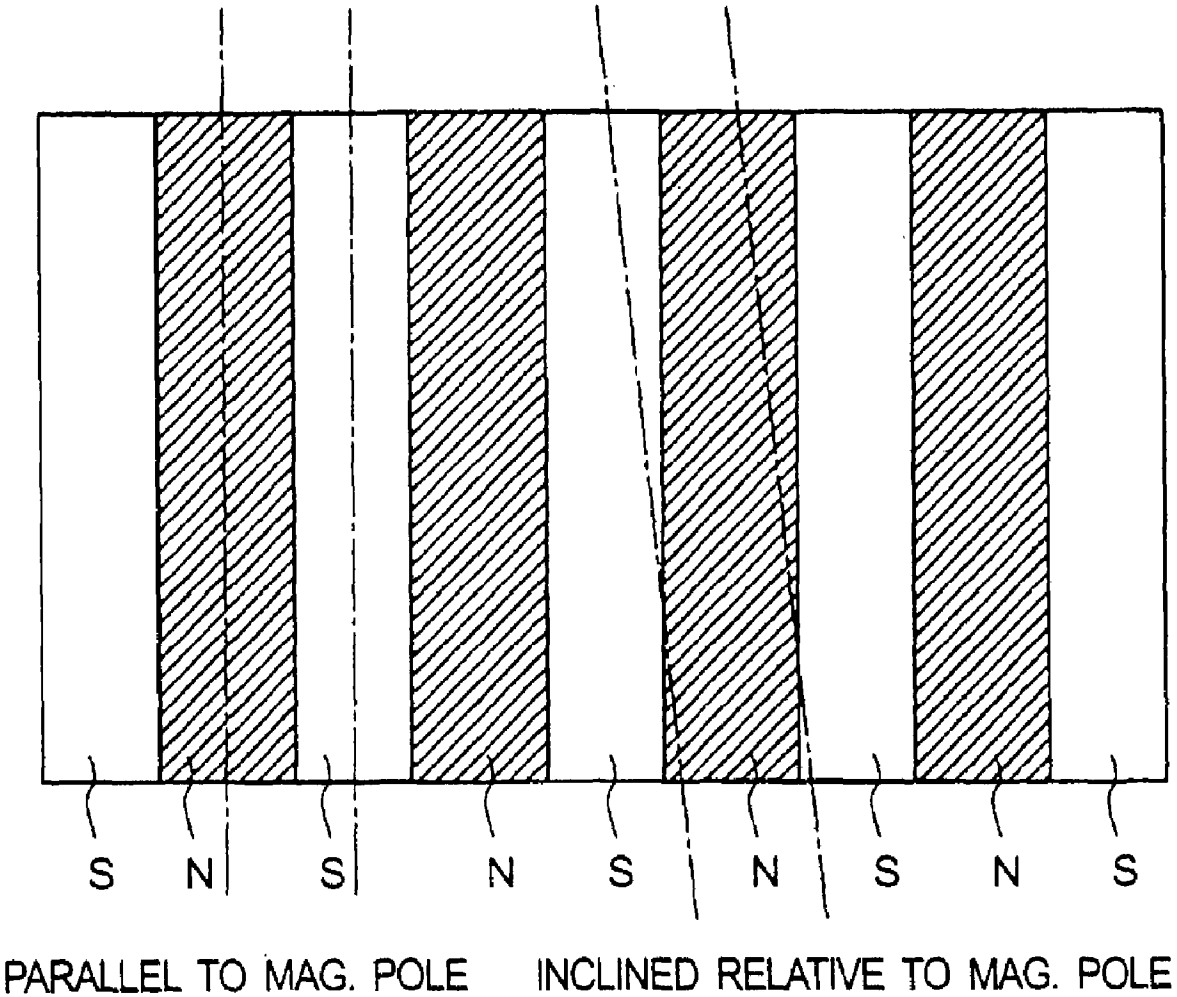
FIG. 5 is a schematic drawing for describing the level of precision at which the elastic magnetic belt is cut out of an elastic magnetic sheet.

To elaborate on the above described reason, first, if the N and S poles are arranged in the widthwise direction of the elastic magnetic belt 15, the level of precision at which the elastic magnetic belt 15 is cut out of a sheet of elastic magnet must be extremely high, for the following reason. That is, generally, a sheet of elastic magnet has a plurality of long and narrow rectangular N pole portions and a plurality of long and narrow S pole portions, which are alternately placed in parallel. Thus, when cutting a sheet of elastic magnet to yield an elastic magnetic belt 15, the N and S poles of which are arranged in a manner to overlap in terms of the widthwise direction, that is, the N and S poles of which extend in parallel to each other in the lengthwise direction of the elastic magnetic belt 15, if a sheet of elastic magnet is not cut perfectly in parallel to the direction in which the N and S poles portions of the elastic magnetic sheet extend, that is, if it is cut even slightly slanted relative to the direction in which the N and S pole portions of the sheet extend, an elastic magnetic belt which is wrong in magnetic pole alignment, that is, an elastic magnetic belt in which the ratio of the N pole portion to the S pole portion in terms of the widthwise direction of the elastic magnetic belt gradually changes in terms of the lengthwise direction of the elastic magnetic belt, is yielded (FIG. 5). Placement of such an elastic magnetic belt may possibly affect the level of precision at which powder is conveyed, which is undesirable.

Secondly, if the N and S poles are positioned on one surface of the elastic magnetic belt 15 and the other, respectively, both the N pole portion and S hole portion of the elastic magnetic belt 15 must be very thin, being therefore weak in magnetic force. In other words, this arrangement makes it difficult to obtain magnetic force by the necessary amount. It is possible to produce an elastic magnetic belt, the N and S poles of which are positioned on one surface thereof and the other, respectively, and which is sufficient in magnetic force. However, the manufacturing cost of such an elastic magnetic belt is too high for the elastic magnetic belt to be put to practical use.

In comparison, in the case of the elastic magnetic belt 15 in this embodiment, the N and S poles of which are alternately arranged in terms of the lengthwise direction of the elastic magnetic belt 15, and which is yielded by cutting a sheet of elastic magnet in the direction roughly perpendicular to the direction in which the rectangular N and S pole portions of the elastic magnetic sheet extend in parallel, the level of accuracy at which the sheet is to be cut to yield the elastic magnetic belt 15 may be lower than that at which the elastic magnetic sheet is to be cut to yield an elastic magnetic belt, the N and S poles of which overlap with each other in the widthwise direction of the elastic magnetic belt. In other words, it is lower in manufacturing cost, being therefore preferable. Further, with such a magnetic pole arrangement, the necessary amount of magnetic force can be relatively easily obtained. As will be evident from the above description, arranging the N and S poles of the elastic magnetic belt 15 alternately in the lengthwise direction of the elastic magnetic belt 15 offers a great deal of merit in terms of cost in consideration of the fact that the powder conveying apparatus is mass-produced.

When the elastic magnet belt 15 was actually pasted in the groove 14*c* of the peripheral surface (edge) 14*b* of the spiral flange 14 so that the N and S poles were alternately positioned along the peripheral surface 14*b* of the spiral flange 14, it was confirmed that the present invention was exceptionally effective. It is thought that the exceptional effectiveness of the present invention is traceable to the pasting of the elastic magnetic belt 15 in the groove 14*c* of the peripheral surface (edge) 14*b* of the spiral flange 14, more specifically, focusing of the magnetic lines of flux by the pasting of the elastic magnetic belt 15 in the groove 14*c*.

EXAMPLE

The following are the specifications of an example of the powder conveying apparatus 10 in this embodiment.

Powder conveyance screw
rotational shaft material: ABS resin
external diameter: 4 mm
length: 423 mm
Spiral flange 14
material: ABS resin
external diameter: 11.5 mm
length: 138 mm
width of peripheral surface: 4.0 mm
depth of groove: 1.0 mm
width of groove: 2.5 mm
Clearance C1

0.75 mm
Elastic magnetic belt 15
material: ferrite rubber magnet
length (circumference): 250 mm
width: 2.0 mm
thickness: 1.0 mm
residual flux density: 240 mT
dimension of N (S) pole portion in terms of lengthwise direction of (circumferential direction): 3 mm (pitch)
Powder conveyance pipe 12
material: PC+ABS resin
internal diameter: 13 mm
external diameter: 16 mm
length of internal surface: 142 mm
Magnetic powder M
material: resinous carrier
amount: 4–6 mg
Object P to be carried
developer toner
Conveyance speed
rotational velocity of screw: 262.7 rpm.

When the powder conveying apparatus 10 was made to meet the above described specifications, or the typical ones, that is, when the powder conveying apparatus 10 was constructed so that its residual flux density and clearance C1 became 240 mT and 0.75 mm, respectively, the powder conveying apparatus 10 could satisfactorily convey the powder.

The various experiments carried out by the inventors of the present invention revealed that the amount of the magnetic force of the magnetic field generating means 15 and the clearance C1 were desired to be set to a value in the range of 100 mT–500 mT, and a value in the range of 0.5 mm–1.5 mm, respectively. When the amount of the magnetic force was set to a value no more than 100 mT, it was impossible to keep the clearance C satisfactorily filled with magnetic powder M, whereas when it was set to a value greater than 500 mT, the conveyance screw 11 was overloaded, which is not desirable. Further, when the amount of the clearance C1 was made to be no more than 0.5 mm, not only did the mass-production cost of a powder conveying apparatus 10 increase, but also, various other problems occurred. For example, when the object P to be conveyed was resinous toner which was rather low in melting point, toner agglomerated, resulting in the blocking or the like. On the other hand, when the clearance C1 was made to be no less than 1.5 mm, the magnetic field generating means 15 had to be increased in magnetic force, and/or the amount of the magnetic powder M had to be increased, adding to the cost of a powder conveying apparatus 10, and/or reducing a powder conveying apparatus 10 in reliability, which is not desirable.

Incidentally, the values of the magnetic force generated by the magnetic field generating means, that is, the residual flux density of the magnetic field generating means, were those obtained by measuring the magnetic force at the surface of the elastic magnetic belt 15 using a properly calibrated instrument prior to the pasting of the elastic magnetic belt 15.

As described above, in this embodiment, the magnetic powder M is adhered to the elastic magnetic belt 15 pasted in the groove 14*c* of the peripheral surface (edge) 14*b* of the spiral flange 14 of the conveyance screw 11. However, this embodiment is not intended to limit the scope of the present invention. In other words, there are other structural arrangements, in accordance with the present invention, for a powder conveying apparatus, which will be described later, and are also very effective on their own.

(i) In this embodiment, the clearance C1 between the internal surface 12*a* of the conveyance pipe 12 and peripheral surface 14*b* of the spiral flange 14 is kept filled with the combination of the magnetic powder M and magnetic field generating means 15. Therefore, even such an object P that cannot be reliably conveyed by a powder conveying apparatus in accordance with the prior art because of the above described problem that the object P in the form of powder accidentally leaks through the clearance C1, can be satisfactorily conveyed. In other words, the powder conveying apparatus 10 in this embodiment is more reliable and precise in terms of powder conveyance than the one in accordance with the prior art.

(ii) In this embodiment, it is unnecessary to reduce the clearance C1 to the smallest possible proportion in order to improve the powder conveying apparatus 10 in powder conveyance accuracy and powder conveyance efficiency. Therefore, it is unnecessary to strictly control the vibrations of the conveyance screw 11. In other words, this embodiment makes it possible to achieve high level of conveyance accuracy and high level of conveyance efficiency while accomplishing cost reduction, for the powder conveying apparatus 10.

(iii) In the case of the powder conveying apparatus 10 in this embodiment, the problems that the powder conveyance accuracy and powder conveyance efficiency reduce due to the accidental leakage of powder through the clearance C1 can be prevented. For example, even in a situation in which it is necessary to reduce the clearance C1 of a powder conveying apparatus in accordance with the prior art, in order to further improve the powder conveying apparatus in powder conveyance efficiency, all that is necessary to improve the powder conveying apparatus 10 in this embodiment in powder conveyance efficiency is to replace the center shaft 13 of the conveyance screw 11 with a metallic shaft, or to take the like measures. In other words, the powder conveying apparatus 10 in this embodiment is far higher in conveyance accuracy and conveyance efficiency than a powder conveying apparatus in accordance with the prior art.

(iv) The method in this embodiment for preventing the flushing or the like phenomenon, that is, the accidental leakage of powder through the clearance C1 in a powder conveying apparatus is far smaller in the possibility of the occurrence of mechanical friction (in particular, surface to surface friction) than a flushing preventing method in accordance with the prior art in which the clearance C1 is sealed by the provision of a mechanical seal as described before. In other words, in the case of the powder conveying apparatus 10 in this embodiment, the agglomeration of powder, for example, toner, as an object to be conveyed, virtually never occurs. Therefore, this embodiment is remarkably effective to prevent the load increase attributable to the agglomeration of the powder to be conveyed, and/or to prevent the noises traceable to the agglomeration of the powder.

Next, an example of a multicolor image forming apparatus employing a rotary developing apparatus equipped with the above described powder conveying apparatus in accordance with the present invention will be described.

[General Structure of Image Forming Apparatus]

Figure 14:
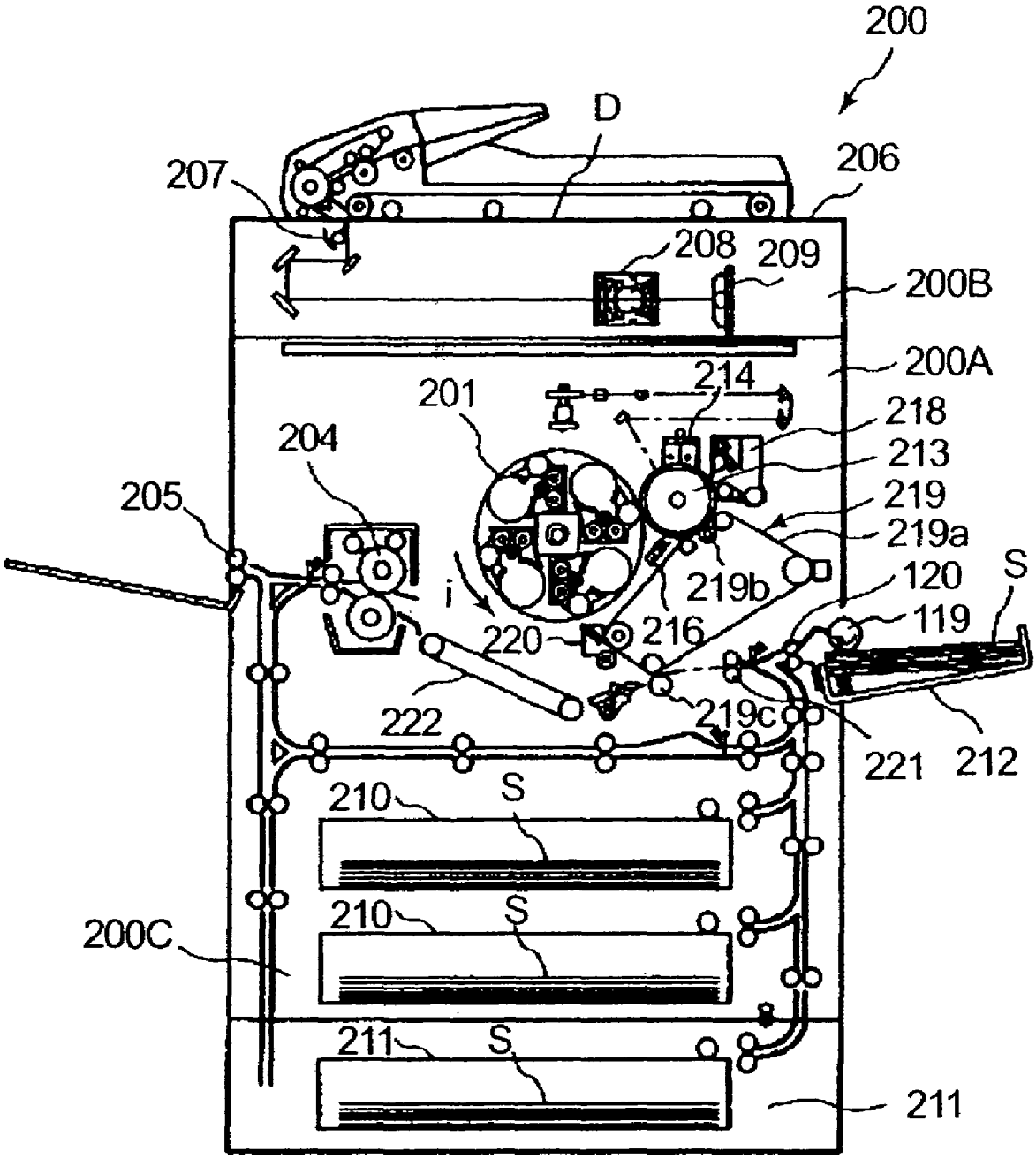
FIG. 14 is a schematic sectional view of another example of an image forming apparatus to which the present invention is applicable.

FIG. 14 is a schematic sectional view of the multicolor image forming apparatus 200 in this embodiment, showing the general structure thereof. The image forming apparatus 200 in this embodiment is a color copying machine for forming a multicolor image on such transfer medium as recording paper, OHP sheet, fabric, etc., with the use of one of electrophoto-graphic image forming methods, in response to image formation signals from an original reading portion of the main assembly thereof or an external host device, for example, a personal computer, connected to the main assembly of the image forming apparatus in a manner to allow communication between the two.

The image forming apparatus 200 is a multicolor image forming apparatus, the image forming portion 200A of which essentially comprises a rotary developing apparatus 201 as a developing means, and an intermediary transfer unit 219 as a transferring means. The rotary developing apparatus 201 has internal powder conveying apparatuses as developer conveying apparatuses. The intermediary transfer unit 219 comprises an intermediary transfer belt 219*a*, onto which the toner images sequentially formed on the photosensitive drum 213 with the use of the rotary developing apparatus 201 are sequentially transferred in layers, and from which the toner images having just been layered thereon are transferred all at once onto the transfer medium S.

Figure 15:
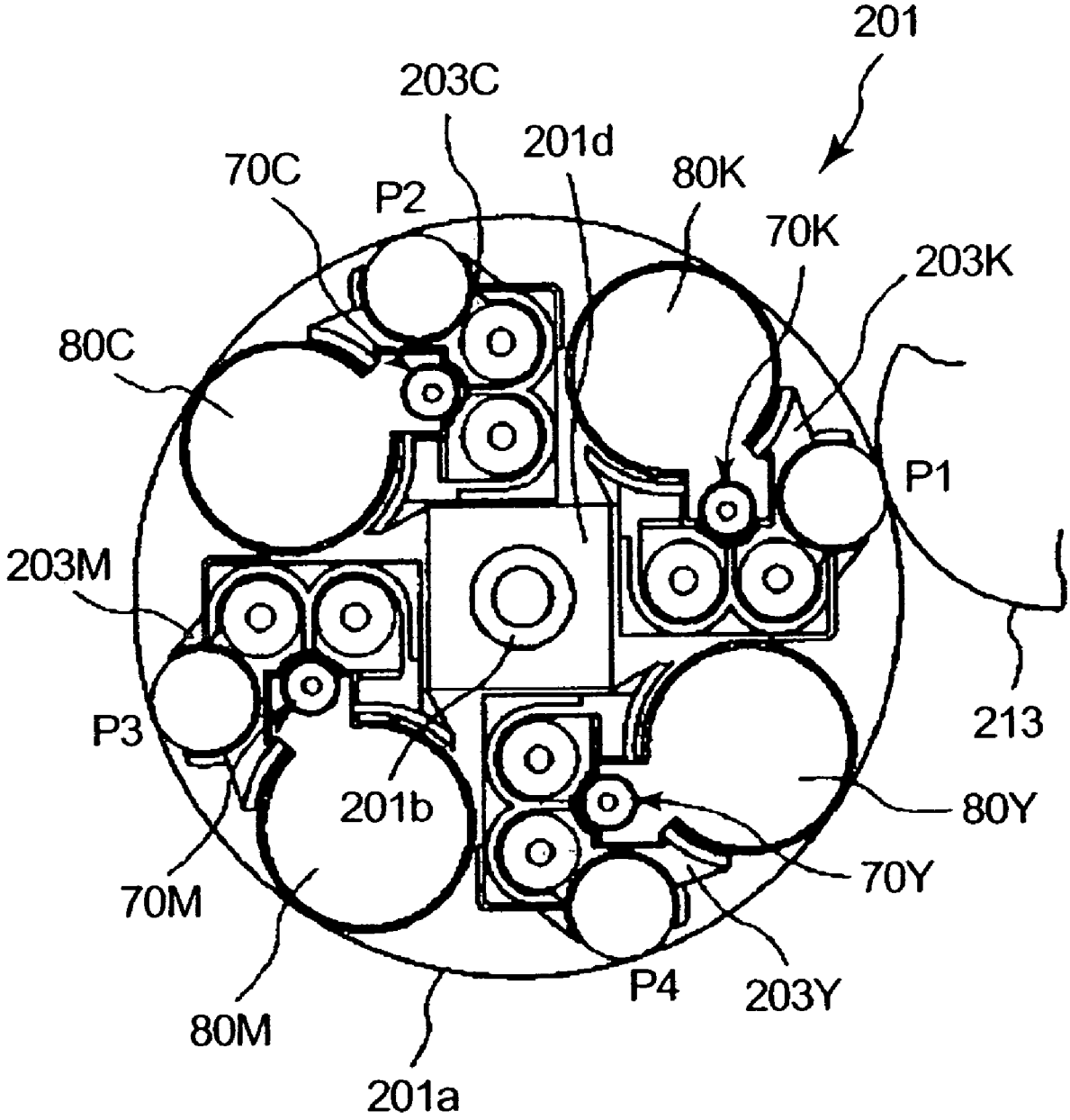
FIG. 15 is a schematic cross-sectional view of the rotary developing apparatus of the image forming apparatus in FIG. 14.

Next, referring to FIG. 15, the rotary developing apparatus 201 in this embodiment comprises a rotary 201*a* as a developing device supporting member, and four developing devices supported by the rotary 201*a*. The four developing devices are yellow, magenta, cyan, and black color component developing devices 203Y, 203M, 203C, and 203K, which use yellow, magenta, cyan, and black developers, respectively. The rotary developing apparatus 201, which will be described later in more detail, also comprises a plurality of powder conveying apparatuses as developer conveying apparatuses 70Y, 70M, 70C, and 70K connected to the plurality of developing devices 203Y, 203M, 203C, and 203K, respectively. Further, the plurality of developing devices 203Y, 203M, 203C, and 203K are enabled to removably hold a plurality of developer supply containers (toner bottles, toner cartridges) 80Y, 80M, 80C, and 80K, respectively, which are removably mountable in the plurality of developing devices 203Y, 203M, 203C, and 203K, respectively (hence, mountable in rotary 201*a*, and apparatus main assembly 100).

The intermediary transfer unit 219 has an endless intermediary transfer belt 219*a* as an intermediary transfer member, which is wrapped around a plurality of rollers, inclusive of a driving roller and a supporting roller, being suspended thereby. The intermediary transfer unit 219 is provided with a transfer roller 219*b* as the primary transfer roller, which is disposed at a predetermined location within the loop of the endless intermediary transfer belt 219*a*, in contact with the belt 219*a*, in a manner to keep the belt 219*a* in contact with the photosensitive drum 213 (creating primary transfer station). As a predetermined primary bias is applied to the transfer roller 219*b*, the toner image is transferred (primary transfer) from the photosensitive drum 213 onto the intermediary transfer belt 219*a*. The intermediary transfer unit 219 is also provided with a transfer roller 219*c* as the secondary transfer member for transferring the toner image on the intermediary transfer belt 219*a* onto the transfer medium S as the transfer medium S is conveyed between the intermediary transfer belt 219*a* and secondary transfer roller 219*c* (secondary transfer station); the toner image is transfeffed onto the transfer medium S as a predetermined secondary transfer bias (voltage) is applied to the secondary transfer roller 219*c*. The intermediary transfer unit 219 is structured so that the secondary transfer roller 219*c* can be placed in contact with, or separated from, the intermediary transfer belt 219*a*. The main assembly (200) is provided with a belt cleaner 220, which is for removing the toner remaining on the intermediary transfer belt 219*a* after the secondary transfer, and which can be placed in contact with, or separated from, the intermediary transfer belt 219*a*.

To describe the operation of the multicolor image forming apparatus 200 in this embodiment, when forming a full-color image (full-color mode), first, an electrostatic latent image corresponding to the black color component, for example, of an original is formed on the photosensitive drum 213, in response to image formation data signals obtained through the color separation of the optical image of an original. Then, the electrostatic latent image on the photosensitive drum 213, which corresponds to the black color component of the original, is developed into an image formed of toner (which hereinafter will be referred to simply as toner image), by the black color developing device 203K having been moved into the development station, in which the black developing device 203K opposes the photosensitive drum 213, by the rotation of the rotary 201*a* of the rotary developing apparatus 201. Then, the toner image on the photosensitive drum 213 is transferred onto the intermediary transfer belt 219*a*, in the primary transfer station, after the toner image is adjusted in potential level by the post-charging device 216.

Next, the intermediary transfer belt 219*a* is rotated one full rotation to enable a toner image, which will be formed next, to be transferred in layers onto the toner image on the intermediary transfer belt 219*a*. During this full rotation of the intermediary transfer belt 219*a*, the rotary 201*a* of the rotary developing apparatus 201 is rotated in the direction indicated by an arrow mark i in the drawing to move the designated developing device into the position in which the designated developing device opposes the photosensitive drum 213, to prepare for the development of the next electrostatic latent image to be formed on the photosensitive drum 213.

The above described sequence comprising the electrostatic image forming process, developing process, and transferring process is repeated until a predetermined number of toner images different in color are transfeffed in layers onto the intermediary transfer belt 219*a*.

Toward the end of the transfer of the last toner image onto the intermediary transfer belt 219*a*, a transfer medium 2 is fed into the main assembly of the image forming apparatus 200, so that it will arrive at the secondary transfer station in synchronism with the arrival of the layered toner images on the intermediary transfer belt 219*a* at the secondary transfer station. Further, the secondary transfer roller 219*c* is placed in contact with the intermediary transfer belt 219*a* in synchronism with the arrival of the transfer medium S at the secondary transfer station. Then, the plurality of toner images different in color on the intermediary transfer belt 219*a* are transferred all at once from the intermediary transfer belt 219*a* onto the transfer medium S by the function of the secondary transfer roller 219*c*. Thereafter, the toner images are turned into a single permanent multicolor image, and the transfer medium S is discharged from the apparatus main assembly 200.

As described above, the transfer medium S fed into the apparatus main assembly 200 is discharged therefrom after an image is formed on the transfer medium S by the image forming portion 200A in accordance with the image formation data signals from the original reading portion 200B.

On the other hand, when forming a monochromatic image, for example, a black-and-white image, the toner image formed on the photosensitive drum 213 with the use of the developing device having the desired color is transfeffed (primary transfer) onto the intermediary transfer belt 219*a*, and then, immediately transfeffed (secondary transfer) onto the transfer medium S. Then, the transfer medium S is discharged from the apparatus main assembly 200 after being subjected to the image fixing process. The productivity of this image forming apparatus in the monochromatic mode is roughly four times higher than that in the full-color mode.

In this embodiment, the rotary 201*a* of the rotary developing apparatus 201 is enabled to hold four color developing devices, that is, the yellow developing device 203Y, magenta developing device 203M, cyan developing device 203C, and black developing device 203B. Obviously, however, the number of the developing devices which the rotary 201*a* is enabled to hold does not need to be limited to four, as will be evident from the gist of the present invention.

Incidentally, the black developing device may be disposed independent from the rotary 201*a*. In such a case, a black image can be formed involving only this black developing device, in other words, without involving the rotary 201*a*.

[Powder Conveying Apparatus]

Next, referring to FIG. 16, the developer conveying apparatuses 70Y, 70M, 70C, and 70B as powder conveying apparatuses, which characterize the present invention, and which are held in the rotary 201*a* of the rotary developing apparatus 201, will be described in detail.

The plurality of developing devices 203Y, 203M, 203C, and 203K are identical in structure and operation, although different in the color of the toner with which they are involved, and so are the plurality of developer conveying apparatuses 70Y, 70M, 70C, and 70K, and plurality of developer supply containers 80Y, 80M, 80C, and 80K. Thus, in the following descriptions of the developing devices, developer conveying apparatuses, and developer supply containers, the referential characters Y, M, C, and K, which indicate the color of the toner for which they are used, will be omitted when describing them in general terms., as long as it is unnecessary to identify the color of the toner for which they are used.

Figure 16:
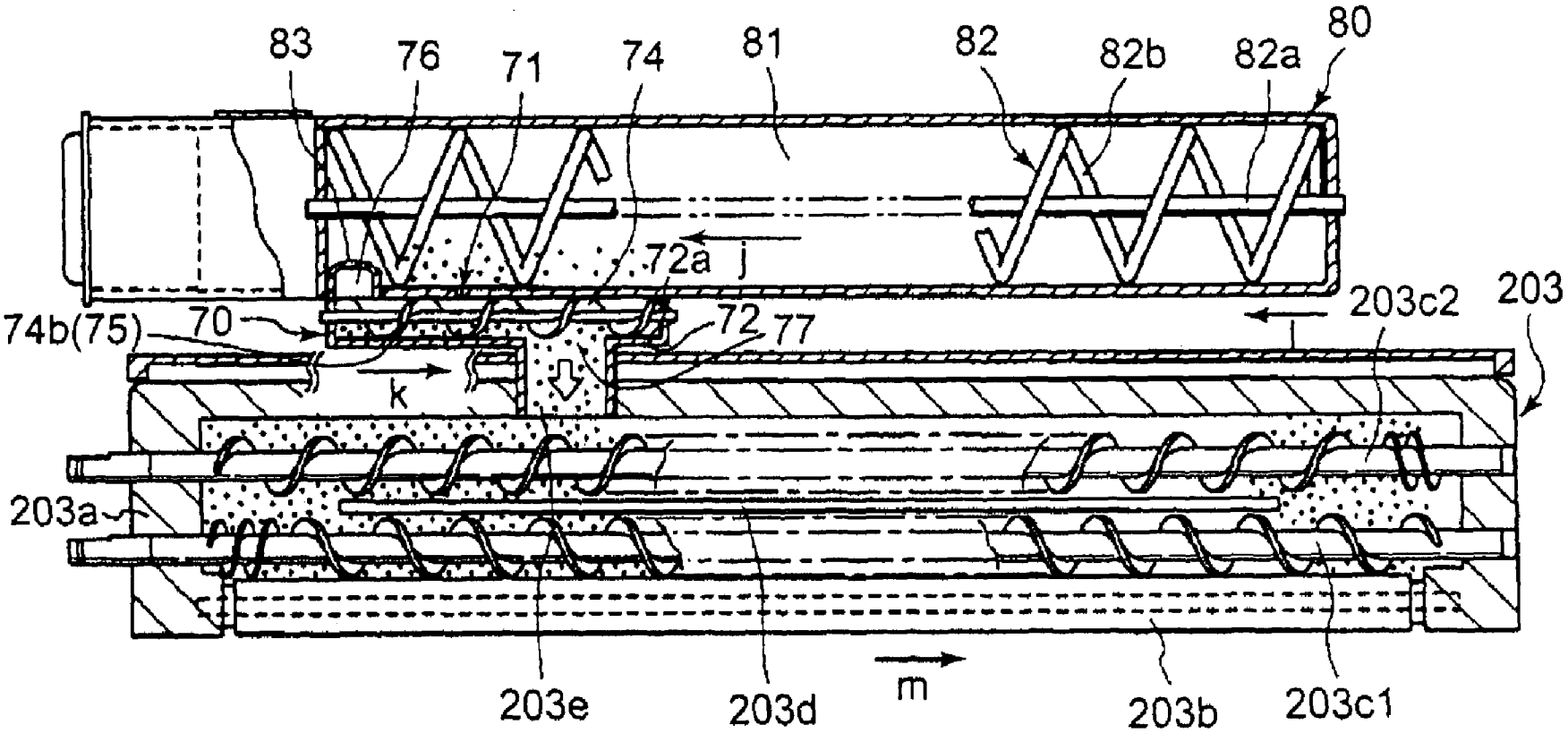
FIG. 16 is a schematic drawing (partially broken, partially sectional, and partially phantom) of the rotary developing apparatus of the image forming apparatus in FIG. 14, describing the developer conveying apparatus in the rotary developing apparatus.

FIG. 16 is a schematic drawing (partially phantom, partially sectional, and partially broken) of the developing device 203 as seen from above. The developer container (container proper) 203*a* of the developing device 203 essentially holds two-component developer, which is the mixture of nonmagnetic resinous toner in the form of particulates (which hereinafter may be referred to simply as toner) and magnetic particulates (carrier). The developer container 203*a* is provided with an opening which faces the photosensitive drum 213. Each developing device 203 is provided with a development sleeve 203*b* as a developer carrying member, which is rotationally supported, being partially exposed through this opening. The development sleeve 203*b* internally holds a stationary magnetic roll as a magnetic field generating means. The developer is held to the peripheral surface of the development sleeve 203*b* by the magnetic force generated by the stationary magnetic roll, and is conveyed by the rotation of the development sleeve 203*b* to the development area, which is where the peripheral surfaces of the development sleeve 203*b* and photosensitive drum 213 oppose each other through the aforementioned opening of the developer container 203*a*. In the development area, the magnetic brush, that is, the crest of the body of two-component developer on the peripheral surface of the development sleeve 203*b*, which was created by the magnetic force from the magnetic roll, is placed virtually or actually in contact with the photosensitive drum 213, while a predetermined development bias is applied to the development sleeve 203*b*. As a result, the toner in the developer is moved from the development sleeve 203*b* onto the photosensitive drum 213 in such a pattern that reflects the pattern of the electrostatic latent image on the photosensitive drum 213, by the electrical field formed between the development sleeve 203*b* and photosensitive drum 213. Consequently, an image reflecting the latent image is formed of the toner, on the photosensitive drum 213. After the development of the electrostatic latent image, the developer remaining on the development sleeve 203*b* is further conveyed by the rotation of the development sleeve 203*b*, and is recovered into the developer container 203*a*.

The developer in the developer container 203*a* is circulated in the developer container 203*a* by a first developer circulation screw 203*c*1 (closer to development sleeve 203*b*) as a developer stirring-conveying member, and a second developer circulation screw 203*c*2 (farther from development sleeve 203*b*) also as a developer stirring-conveying member, while being stirred and mixed. The first and second developer circulation screws 203*c*1 and 203*c*2 are disposed roughly in parallel to the development sleeve 203*b*. As for the direction in which the developer is circulated in the developer container 203*a* in this embodiment, the developer is moved in the direction indicated by an arrow mark m in the drawing by the first developer circulation screw 203*c*1, and is moved in the direction indicated by an arrow mark 1 by the second developer circulation screw 203*c*2. There is a partitioning wall 203*d* in the developer container 203*a*, which divides the internal space of the developer container 203*a* into two sub-spaces (semicylindrical) in which the first and second developer circulation screws 203*c*1 and 203*c*2 are disposed one for one. The lengthwise ends of this partitioning wall 203*d* are not in contact with the internal surface of the developer container 203*a*, leaving passages through which the developer can be moved from the aforementioned one sub-space to the other. Thus, the developer can be passed between the first and second developer circulation screws 203*c*1 and 203*c*2.

Also referring to FIG. 16, to the developing device 203, a developer supply container 80 is connected, with developer conveying apparatus 70 disposed between developing device 203 and developer container 80. The developer conveying apparatus 70 has a roughly cylindrical conveyance pipe 72 as a developer conveying portion, which is extended roughly in the horizontal direction. One of the lengthwise ends of the conveyance pipe 72 is provided with a developer toner inlet 76, which is open upward for receiving toner, as powder to be conveyed, from the developer supply container 80, as the toner falls from the developer supply container 80, and the other lengthwise end of the conveyance pipe 72 is provided with developer outlet 77, which is open downward, for supplying the developing device 203 with toner. In the conveyance pipe 72, a developer conveyance screw 71, as a developer conveying means, is rotatably supported so that its rotational axis roughly coincides with the axial line of the conveyance pipe 72.

The developer supply container 80 comprises a roughly cylindrical developer storage portion 81, which stores toner supply, or replenishment toner. In the developer storage portion 81, a toner conveyance screw 82 is disposed, which comprises a rotational axle 82*a*, and a spiral toner conveying portion 82*b* which rotates about the rotational axle 82*a*. Thus, as driving force is transmitted, as necessary, to the toner conveyance screw 82 from the driving means (unshown) of the apparatus main assembly 200, the toner in the developer storage portion 81 is conveyed in the direction indicated by an arrow mark j in the drawing, and eventually, falls into the conveyance pipe 72 of the developer conveying apparatus 70, through the toner outlet 83 of the developer storage portion 81, which is connected to the toner inlet 76 of the developer conveying apparatus 70.

As driving force is transmitted, as necessary, to the conveyance screw 71 of the developer conveying apparatus 70 from the motor (unshown) as a driving means of the apparatus main assembly 200, the toner in the conveyance pipe 72 is conveyed in the direction indicated by an arrow mark k in the drawing, and eventually, falls into the developer container 203*a* of the developing device 203, through the developer outlet 77 of the developer conveying apparatus 70, and developer inlet 203*e* of the developing device 203, which is connected to the developer outlet 77.

In this embodiment, the developer conveying apparatus 70 is structured so that the amount by which toner is supplied to the developing device 203 is controlled by controlling the length of time (number of revolutions) the conveyance screw 71 is driven by the driving means (unshown), in response to the amount by which the developing device 203 is to be supplied with developer, and which is calculated by a controlling means (unshown). The method for calculating the amount by which the developing device 203 is to be supplied with developer, and the method for controlling the driving means, are optional; any method known in the field of this business may be employed.

As described above, the operational speed, or productivity, of an image forming apparatus can be improved by increasing the rotational speed of the rotary 201*a* of the rotary developing apparatus 201. However, increasing the rotational speed of the rotary 201*a* creates a problem for the following reason. That is, the higher the rotational speed of the rotary 201*a*, the greater the shocks which occur at the initiation and cessation of the rotation. Further, if toner is reduced in particle diameter beyond a certain value in order to improve image quality, toner behaves virtually like liquid, in the conveyance pipe 72, at the beginning and ending of the rotation of the rotary 201*a*; in other words, the so-called liquefaction of toner occurs, as described before. Thus, it occurs sometimes that as the rotary 201*a* begins to rotate or as it stops, toner sometimes slips through the clearance between the internal surface of the conveyance pipe 72 and the peripheral surface of the conveyance screw 71, accidentally entering the developing device 203 from the developer conveying apparatus 70.

Further, in recent years, toner has been substantially reduced in particle diameter in order to improve image quality. Moreover, in order to form a high quality image, toner must be supplied to the developing device 203 by a highly precise amount (rate). In addition, when it is necessary to increase productivity, the speed at which the rotary 201*a* is rotated must be increased to reduce the length of time necessary to ready a designated developing device for development, because prior to the development, the development sleeve 203*b* must be rotated by a sufficient number of times for stabilizing the state of the toner coat on the development sleeve 203*b*, and also, because the first and second developer circulation screws 203*c*1 and 203*c*2 must be rotated a sufficient number of times for keeping the toner and carrier in the developer container uniformly mixed.

However, if the rotary 201*a* is rotated at a speed higher than a certain value, the above mentioned toner liquefaction occurs. As a result, the toner sometimes slips through the clearance between the internal surface 72*a* of the conveyance pipe 72 and the peripheral surface 74*b* of the spiral flange 74 of the conveyance screw 71, accidentally entering the developing device 203. Therefore, the required level of preciseness at which toner is to be supplied to the developing device 203 cannot be accomplished, immensely affecting the level of stability at which images are formed.

Thus, in this embodiment, an elastic magnet belt cut out of a sheet of elastic magnet is pasted to the peripheral portion (edge) of the spiral flange of the conveyance screw of the developer conveying apparatus 70.

To describe in more detail, referring to FIG. 16, in this embodiment, an elastic magnetic belt 75 as a magnetic field generating means cut out of a sheet of elastic magnet is pasted to the peripheral surface (edge) 74*b* of the spiral flange 74 of the conveyance screw 71.

With the provision of this elastic magnetic belt 75, the magnetic powder, which in this embodiment is magnetic carrier, preferably, virtually the same as the magnetic carrier as that of the two-component developer, is adhered to the elastic magnetic belt 75 in a manner of cresting, filling thereby the clearance between the peripheral surface 74*b* of the spiral flange 74 of the conveyance screw 71 and the internal surface 72*a* of the conveyance pipe 72.

Therefore, developer can be prevented from accidentally flowing out of the conveyance pipe 72, without reducing the efficiency with which developer is conveyed to the developing device 203.

Incidentally, when single-component magnetic toner is used as developer, the magnetic toner can be made to play the role of magnetic powder. In other words, the magnetic toner can be adhered to the elastic magnetic belt 75 in a manner of cresting, filling thereby the clearance between the peripheral surface 74*b* of the spiral flange 74 of the conveyance screw 71 and the internal surface 72*a* of the conveyance pipe 72.

By designating the developer conveying apparatus 70 as described above, even if powder to be conveyed is toner with an extremely small particle diameter, it can be conveyed at a high level of efficiency by a precise amount (at a precise rate) by the spiral flange 74 of the conveyance screw 71. Therefore, even if the conveyance screw 71 is rotated by a very small angle to precisely control the amount by which developer is supplied to the developer container 203*a*, the developing device 203 is provided with toner by an amount virtually exact to the intended amount. Also by designing the developer conveying apparatus 70 as described above, not only can the flushing be prevented without reducing the conveyance efficiency and the level of precision at which toner is conveyed, even if the rotary 201*a* is increased in speed, in other words, even under the condition in which the toner liquefaction is likely to occur due to the increase in the shocks or the like caused by the starting or stopping of the rotation of the rotary 201*a*. Therefore, it is possible to achieve a high level of image quality despite the increase in the operational speed.

Further, with the provision of the above described structural arrangement, it is unnecessary to reduce the clearance between the conveyance screw 71 and internal surface 72*a* of the conveyance pipe 72 to the smallest possible proportion in order to prevent the powder leakage. Therefore, it is possible to reduce the manufacturing cost. Further, even when toner with a low melting point is used, such problems that the toner passage is blocked due to toner agglomeration; the amount of the force for driving the conveyance screw 71 increases; abnormal noises occur; etc., can be prevented.

Further, the higher the speed of an image forming apparatus, the shorter the length of time the rotary 201 of the developing apparatus 201 can be kept stationary to allow a given developing device 203 in the development position (development station) in which the developing device 203 opposes the photosensitive drum 213, and therefore, the shorter the length of time the developing device 203 can be supplied with toner while it is in the development position. This reduction in the time afforded for supplying the developing device 203 with toner can be compensated for by increasing the rotational speed of the conveyance screw 71. However, the increase in the rotational speed of the conveyance screw 71 may result in the above described problems. In this embodiment, however, even if the number of times the conveyance screw 71 is rotated per unit of time is increased, the level of preciseness at which toner is conveyed and the efficiency with which toner is conveyed do not reduce. Therefore, toner is reliably conveyed. Therefore, even if an image forming apparatus is increased in operational speed, the apparatus keeps on yielding high quality images.

The details of the structure of the developer conveying apparatus 70 held in the rotary 201*a* of the developing apparatus 201 is the same as those in the above described example of a developer conveying apparatus.

One of the essential portions of the developer conveying apparatus 70 held in the rotary 201*a* is a powder conveying apparatus such as the above described one. In principle, the conveyance pipe 72 in this example is identical in structure to the conveyance pipe in Example 1. In other words, the length between the toner inlet 76 and toner outlet 77 is virtually the same as that in Example 1, and so are the conveyance screw 71, magnetic field generating means 75, and rotational speed of the conveyance screw 71. The rotational speed of the rotary 201*a* in this embodiment is 125 rpm.

In the experiments carried out to confirm the developer conveying performance of the developer conveying apparatus 70 structured as described above, none of the above described problems, that is, the flushing (phenomenon that a large amount of developer unexpectedly pours into conveyance pipe) which occurs as soon as the developer outlet of a developer supply container is opened, blocking, abnormal noises, etc., which are attributable to toner agglomeration, occurred, and therefore, toner was conveyed very efficiently and precisely.

In this embodiment, the developer stored in a developer supply container is a mixture of nonmagnetic toner and magnetic carrier, contributing thereby to the prolongation of the carrier life. In other words, the magnetic seal is formed because the magnetic carrier in the two-component developer is made to crest by the magnetic field.

Thus, having magnetic carrier in the replenishment developer in a developer supply container is beneficial, because even if the magnetic carrier which is filling the clearance between the conveyance pipe (conveyance portion) and conveyance screw (conveying means) peels away with the elapse of time, the developer conveying apparatus is supplied with magnetic carrier by the replenishment developer from a developer supply container.

As for the weight ratio of the magnetic carrier in the replenishment developer, it is desired to be in the range of 5–30%, preferably, 8–20%, in. order to maintain the effects of the present invention.

Figure 17:
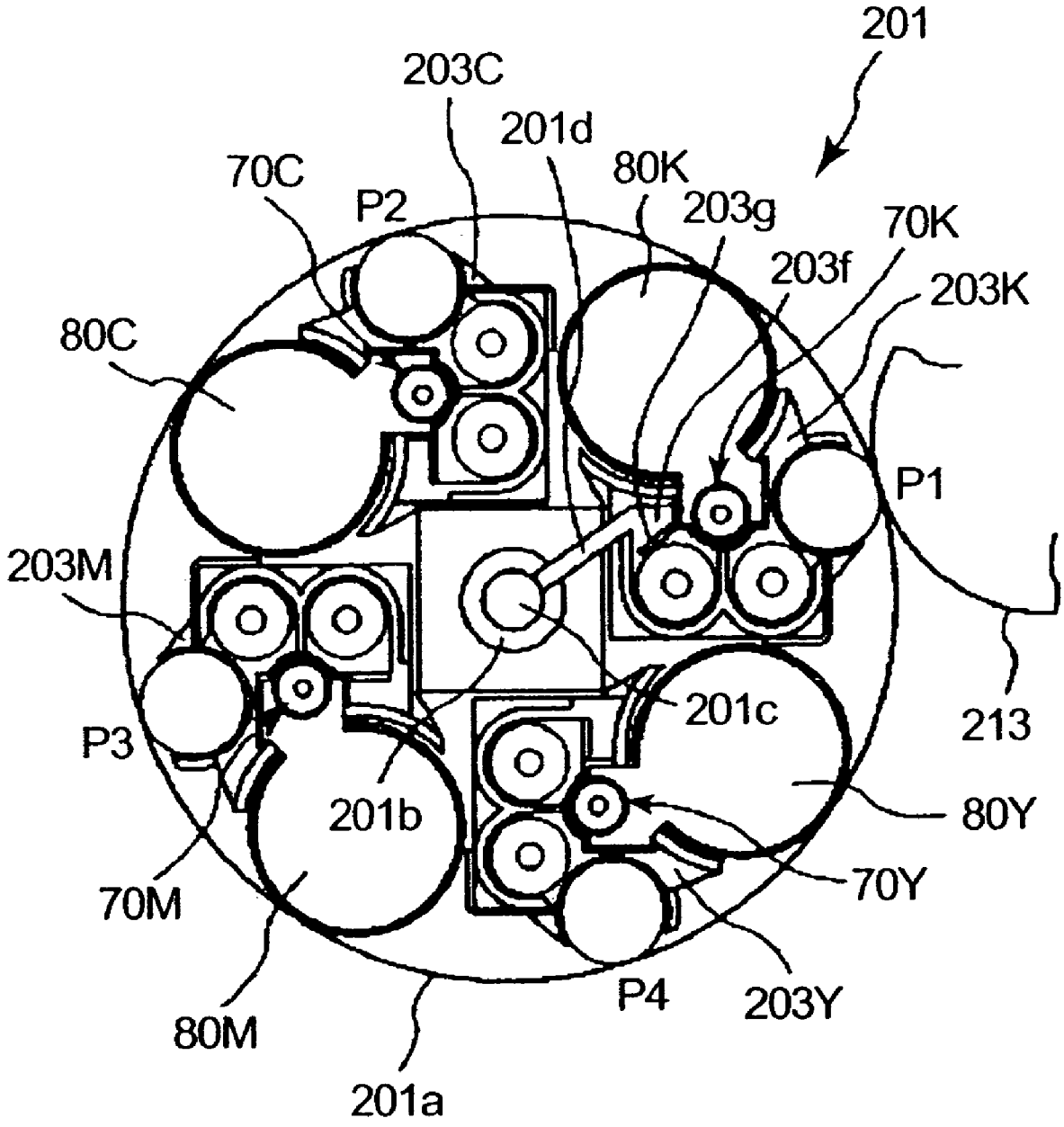
FIG. 17 is a schematic cross-section of the rotary developing apparatus of the image forming apparatus in FIG. 14, equipped with an automatic carrier replenishment mechanism, showing the general structure thereof.
Figure 18:
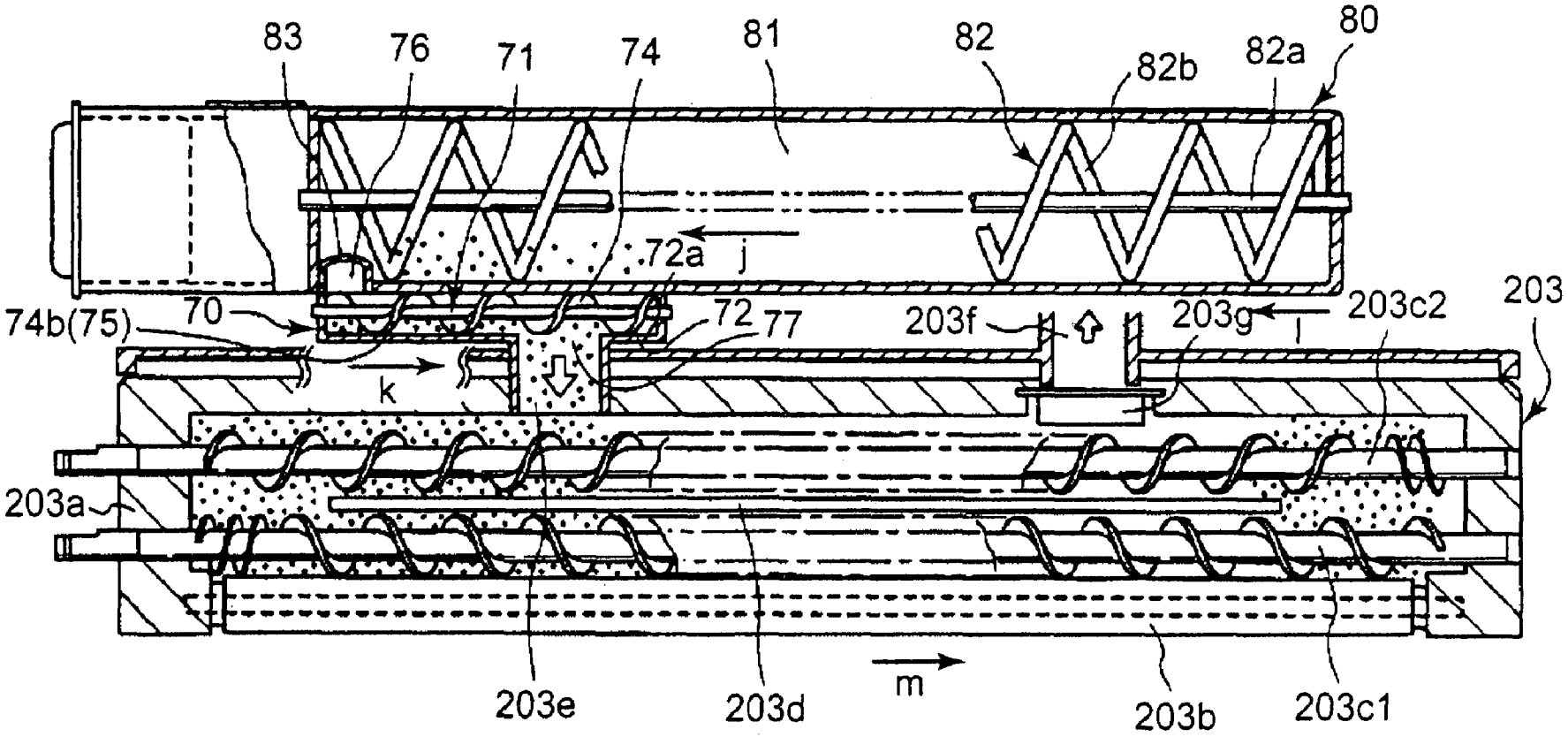
FIG. 18 is a schematic drawing (partially broken, partially sectional, and partially phantom) of the rotary developing apparatus of the image forming apparatus in FIG. 14, equipped with an automatic carrier replenishment mechanism, describing the developer conveying apparatus in the rotary developing apparatus.
Figure 19:
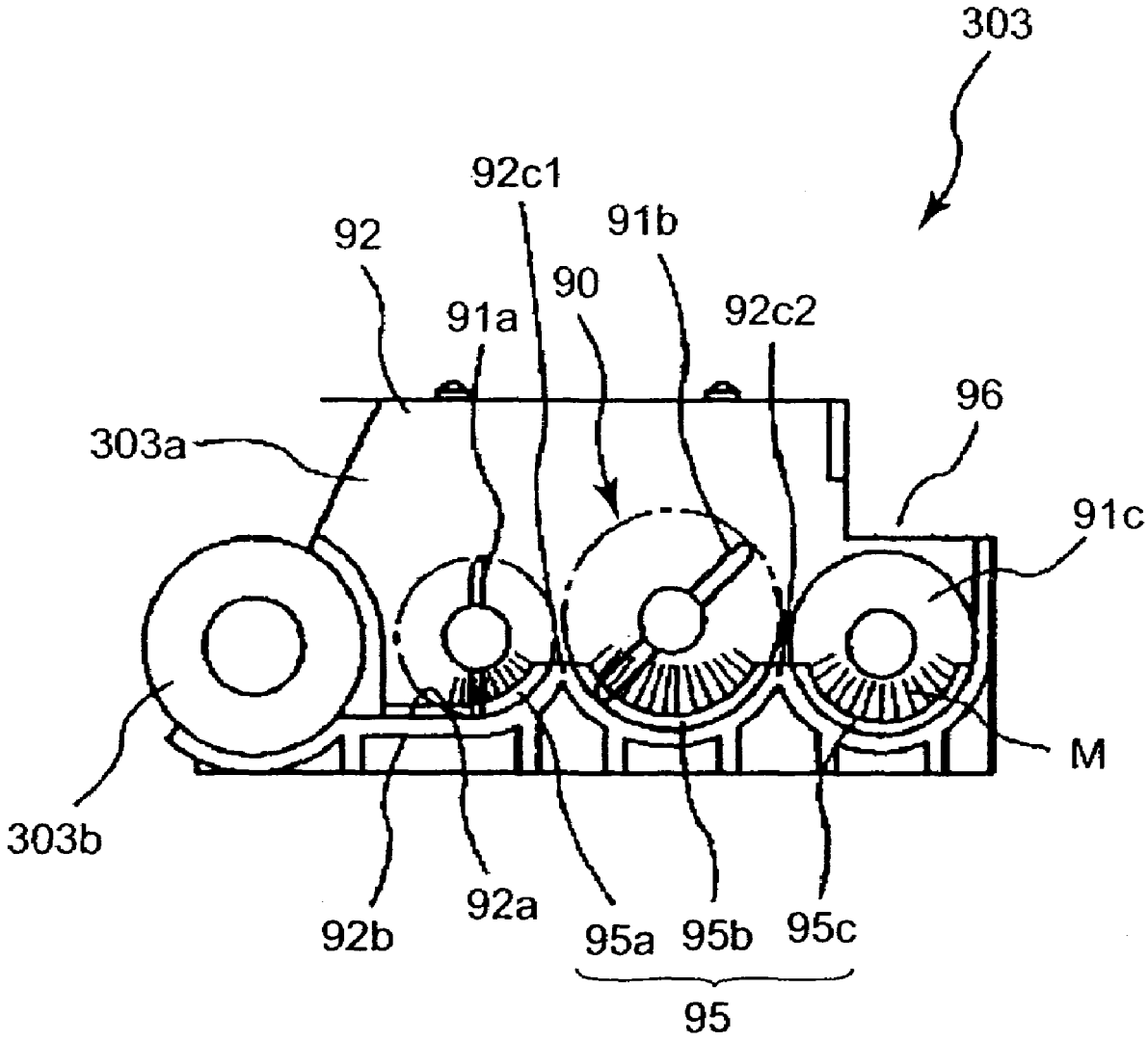
FIG. 19 is a schematic sectional view of a developing device equipped with a powder conveying apparatus in accordance with the present invention, showing the general structure of the essential portions thereof.
Figure 20:
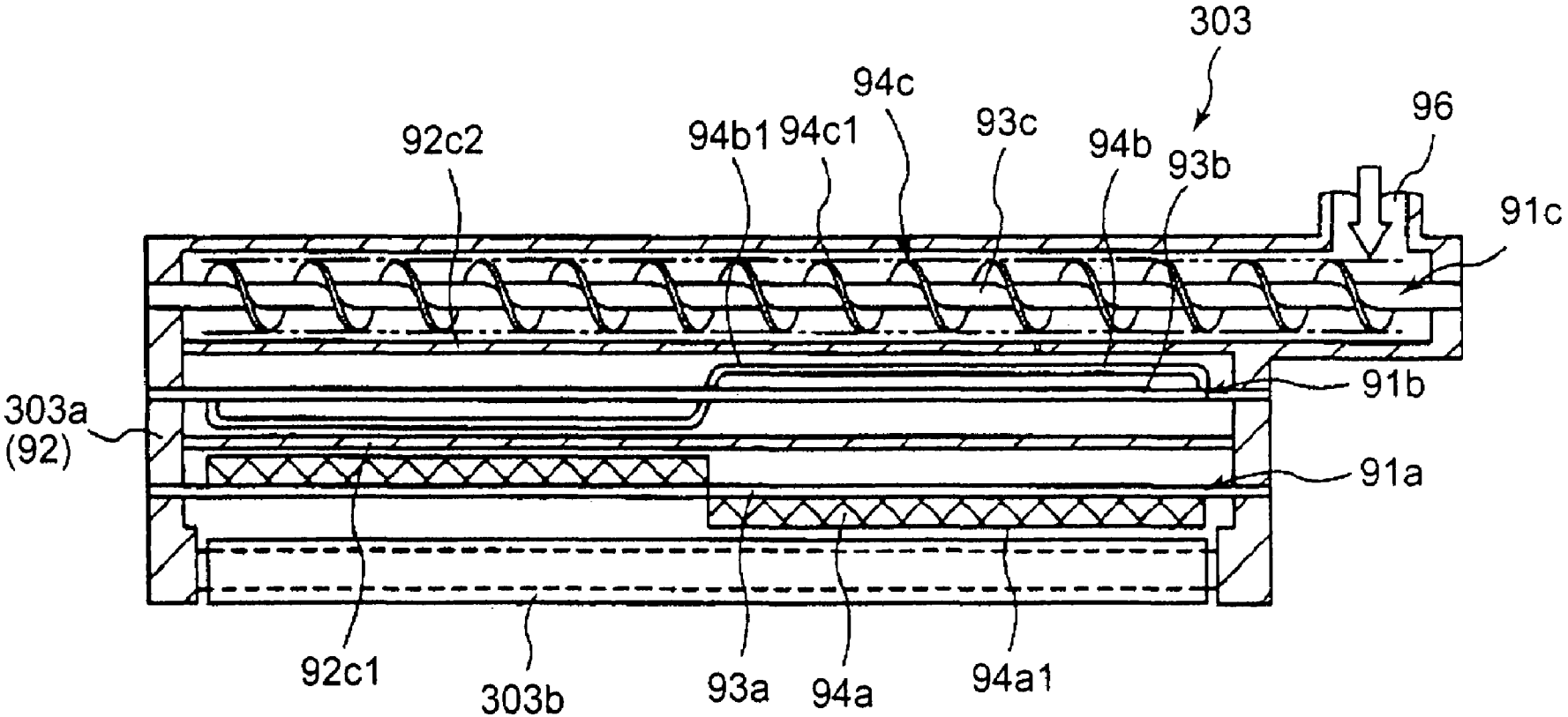
FIG. 20 is a schematic drawing (partially broken, partially sectional, and partially phantom) of the rotary developing apparatus of the image forming apparatus in FIG. 14, as seen from above, describing the developer conveying apparatus in the rotary developing apparatus.
Figure 21:
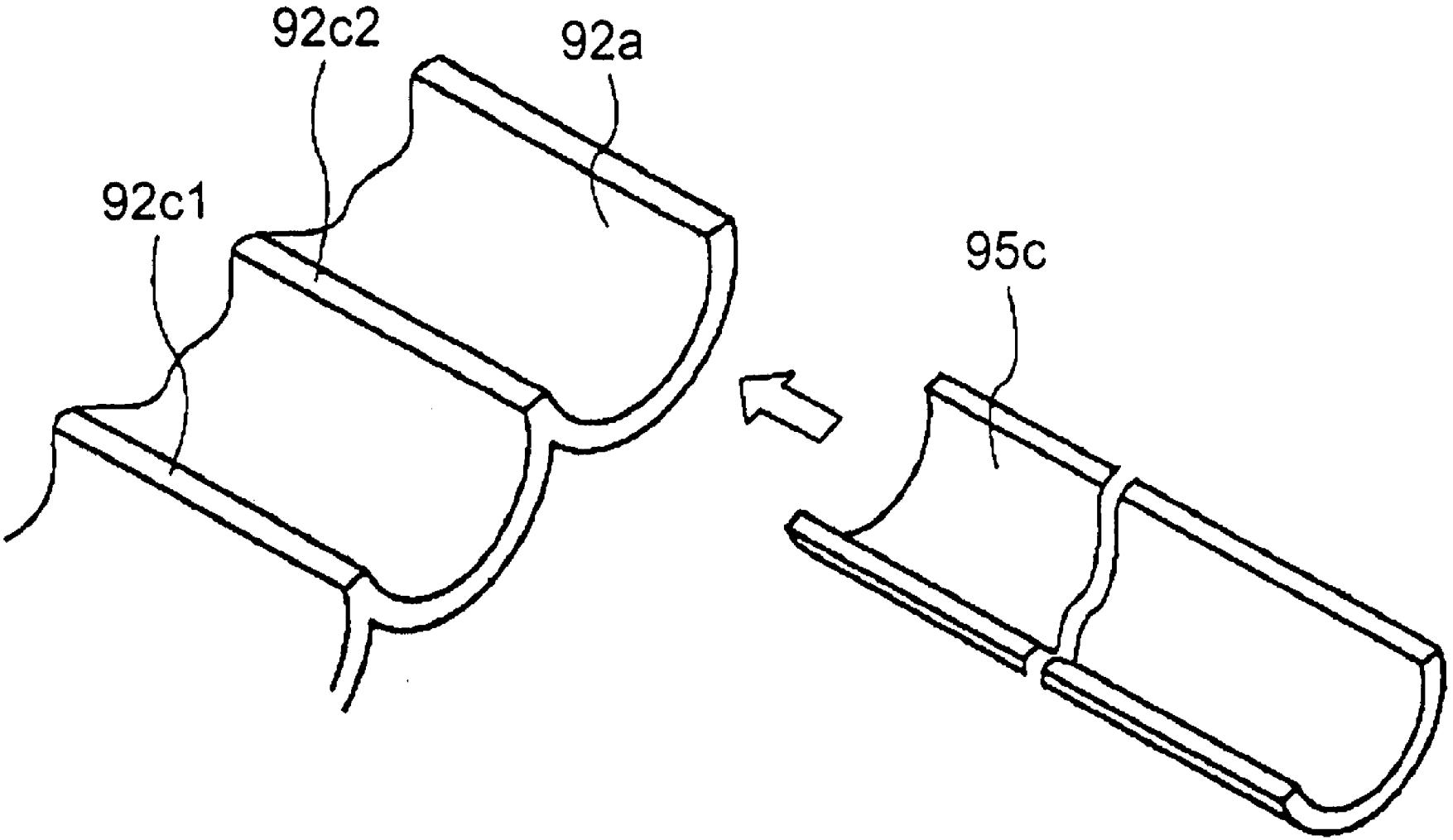
FIG. 21 is a schematic perspective view of the essential portions, that is, the powder conveyance pipe and elastic magnetic sheet, of the powder conveying apparatus in FIG. 19, prior to the assembly thereof, describing the positioning of the elastic magnetic sheet of the developing device shown in FIG. 19.

At this time, referring to FIGS. 17 and 18, an example of a developing apparatus employing "automatic carrier rejuvenation technology" for supplying carrier along with toner will be described. The developer container 203*a* of this developing apparatus is provided with a developer outlet 203*f*, which is on the upstream side, in terms of the direction in which the developer is circulated in the developer container 203*a*, of the toner inlet 203*e* for receiving the replenishment developer, and which is open upward, for example. This toner outlet 203*f* is provided with a shutter 203*g*, which is rotated by gravity so that it remains open only when the developing device 203 is in the development position P1, for example, in which the developing device 203 opposes the photosensitive drum 213. Further, the rotary 201*a* of the rotary developing apparatus 201 is provided with a developer discharge passage 201*d*, which becomes connected to the developer outlet 203*f* of the developing device 203 as the developing device 203 moves into the development position P1. The rotary 201*a* is also provided with a discharged developer conveyance passage 201*c*, which is connected to the developer discharge passage 201*d*.

Thus, as two-component developer, or mixture of toner and carrier at a predetermined ratio (for example, mostly toner and a small amount of carrier) as replenishment developer is supplied to the developing device 203 from a developer supply container 80 while the developing device 203 is in the development position P1, the excessive carrier is made to overflow through the abovementioned developer discharge outlet 203*f*, and flows into the discharged developer conveyance passage 201*c* through the abovementioned developer discharge passage 201*d*. Then, the excessive carrier is conveyed toward one of the lengthwise ends of the discharged developer conveyance passage 201*c*, by a conveyance screw, for example, as a conveying means disposed in the discharged developer conveyance passage 201*c*, and is recovered into a recovery container located at the lengthwise end of the conveyance passage 201*c*, for example.

Embodiment 2

Next, an image forming apparatus in accordance with the present invention, which is different from the image forming apparatus in the first embodiment, will be described.

Figure 11:
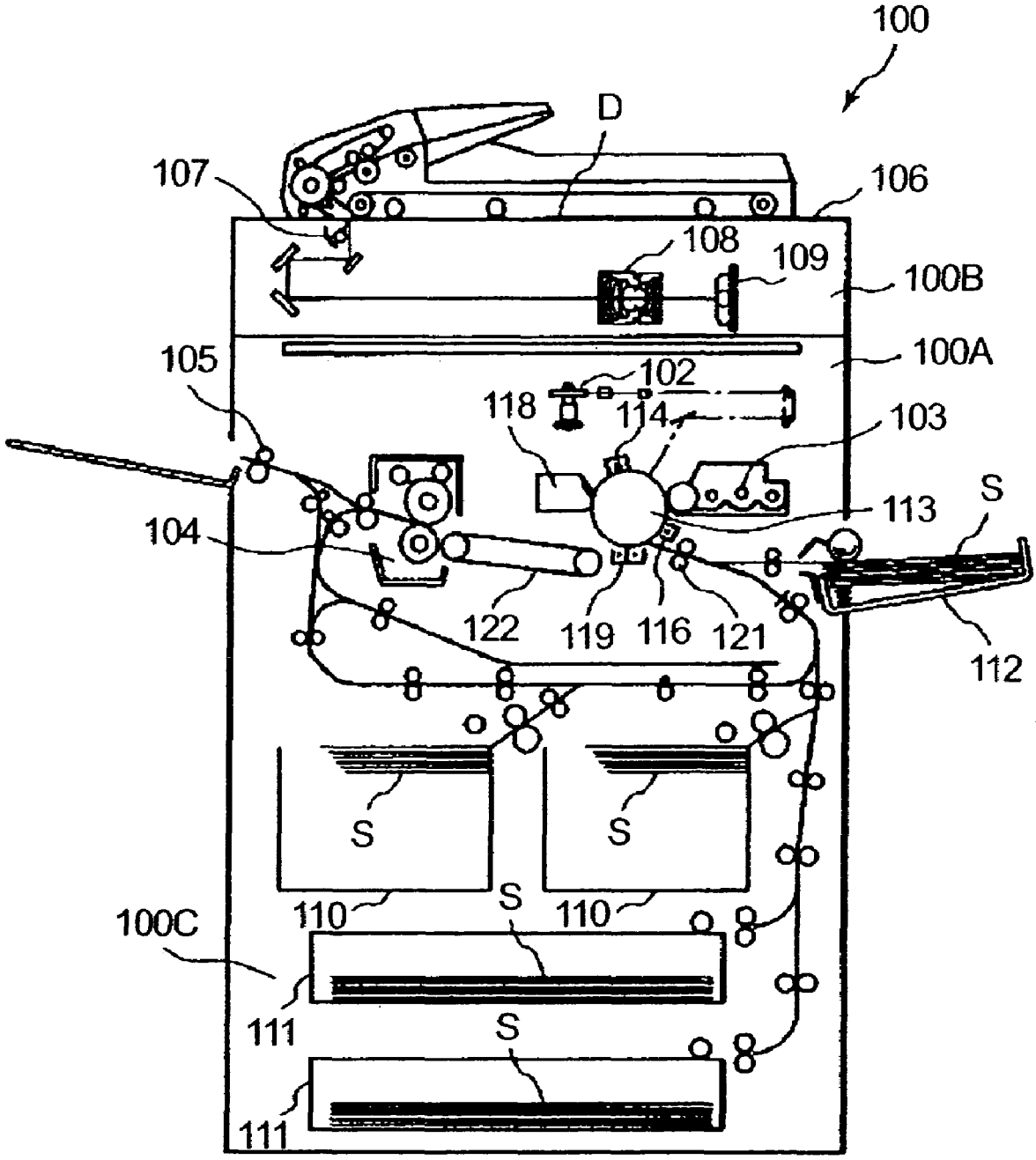
FIG. 11 is a schematic sectional view of an example of an image forming apparatus to which the present invention is applicable.

FIG. 11 is a schematic sectional view of the image forming apparatus in this embodiment of the present invention. The image forming apparatus 100 in this embodiment is an electrophotographic copying machine for forming a black-and-white image on such transfer medium as recording paper, OHP sheet, fabric, etc., with the use of one of electrophotographic image forming methods, in response to image formation signals from an original reading portion of the main assembly thereof, or an external host device, for example, a personal computer, connected to the main assembly of the image forming apparatus in a manner to allow two-way communication.

[General Structure of Image Forming Apparatus]

First, the general structure of the image forming apparatus 100 will be described. The main assembly (100) of the image forming apparatus 100 essentially comprises: an image forming portion 100A; an original reading portion 100B having an original placement platen 106, a light source 107, a lens system 108, a CCD unit (photo-electric transducing means) 19, etc.; and a sheet feeding portion 100C.

The sheet feeding portion 100C has: a pair of cassettes 110 and 111 which hold transfer mediums S, and are removably mountable in the main assembly 100; and a manual feed tray 112. The transfer medium S is fed into the apparatus main assembly from one of these cassettes 110 and 111, or the manual feed tray 112.

The image forming portion 100A comprises: a photosensitive drum 113, that is, a cylindrical electrophotographic photosensitive member; a primary charging device 114 as a charging means; a developing device 103 as a developing means for forming a so-called toner image by supplying the photosensitive drum 113 with developer; a post-charging device 116 for adjusting image quality after development; a drum cleaner 118 as a cleaning means for clearing the photosensitive drum 113 of residual toner; a transfer charging device 119 as a transferring means for transferring a toner image from the photosensitive drum 113 onto the transfer medium S; etc.

The image forming apparatus in this embodiment will be described with reference to a black-and-white image forming apparatus which employs only a black "color" developing device 103 which uses black developer. However, from the standpoint of the gist of the present invention, the number of developing devices does not need to be limited to one. Obviously, the present invention is applicable just as well to a multicolor image forming apparatus employing a plurality of developing devices, as it is to a monochromatic (black-and-white) image forming apparatus 100.

Figure 13:
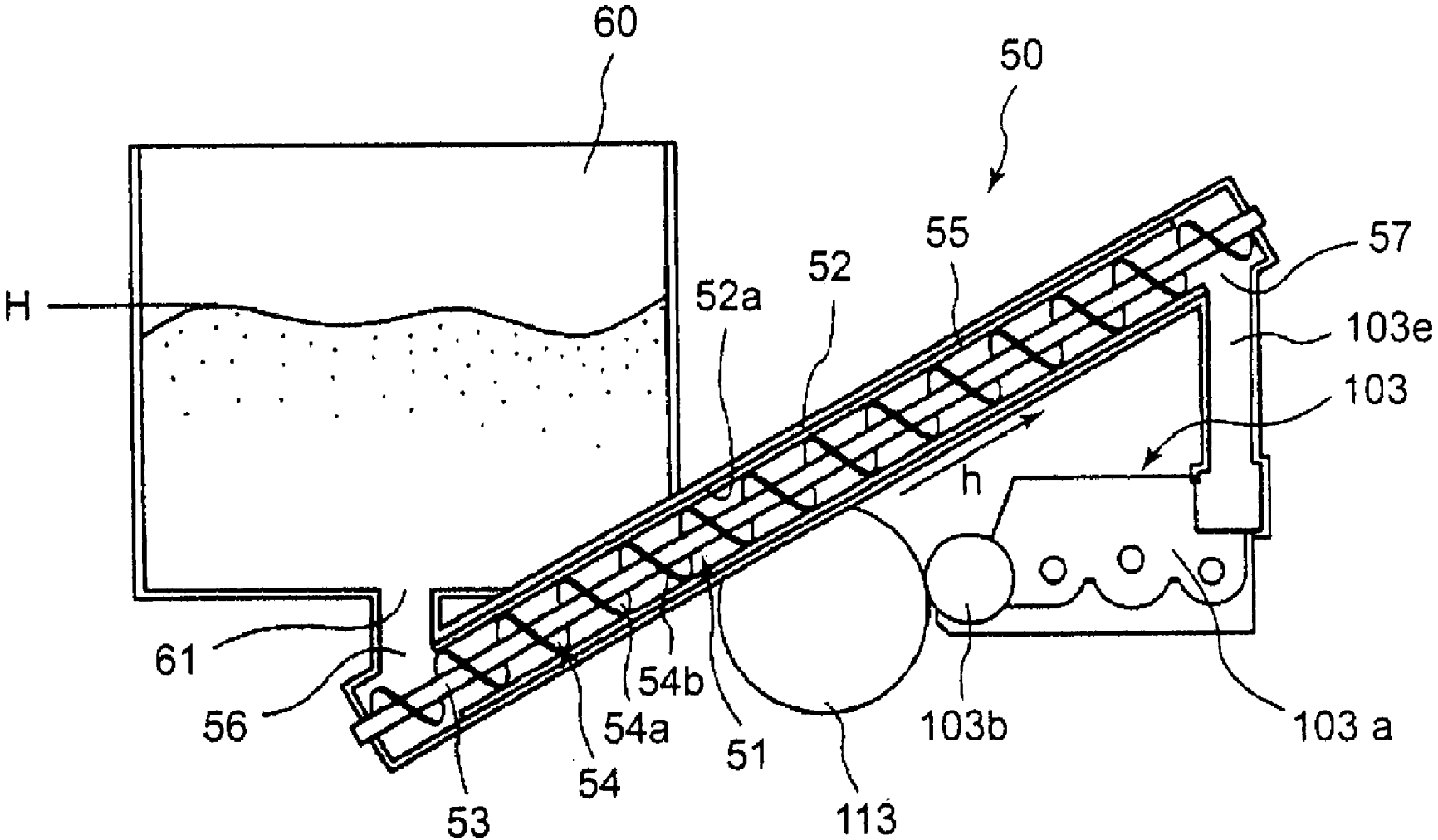
FIG. 13 is a schematic sectional view of the diagonal hoist developer conveying apparatus of the image forming apparatus in FIG. 11, showing the general structure of the essential portions thereof.

The developing device 103 in this embodiment uses magnetic single-component developer (toner), that is, developer made up of virtually resinous toner particles alone (although it may contain ordinary external additives and the like). Referring to FIG. 13, the developer container (container proper) 103*a* of the developing device 103 has an opening which faces the photosensitive drum 113. The developing device 103 is provided with a development sleeve 103*b* as a developer carrying member, which is rotationally supported, being partially exposed through this opening. The development sleeve 103*b* internally holds a stationary magnetic roll as a magnetic field generating means. The developer is held to the peripheral surface of the development sleeve 103*b* by the magnetic force generated by the magnetic roll, and is conveyed by the rotation of the development sleeve 103*b* to the development area, which is where the peripheral surfaces of the development sleeve 103*b* and photosensitive drum 113 oppose each other through the aforementioned opening of the developer container 103*a*. In the development area, the toner is supplied from the development sleeve 103*b* onto the photosensitive drum 113 in a manner to reflect the pattern of the electrostatic latent image on the photosensitive drum 113, by the electric field formed between the development sleeve 103*b* and peripheral surface 113 by the function of a predetermined development bias voltage applied to the development sleeve 103*b* during development. As a result, a toner image is formed on the photosensitive drum 113.

On the upstream side of the image forming portion 100A in terms of the direction in which the transfer medium S is conveyed, a pair of registration rollers 121 is disposed, which is for improving the level of the preciseness at which the transfer medium S is oriented relative to the transfer medium conveyance direction, and also, for synchronizing the conveyance of the transfer medium S with the formation of the toner image on the photosensitive drum 113, whereas on the downstream side, a recording medium conveying apparatus 122 for conveying the transfer medium S after the toner image transfer, a fixing apparatus for fixing the unfixed image on the transfer medium S, a pair of discharge rollers 105 for discharging the transfer medium S out of the image forming apparatus main assembly after the fixation of the image to the transfer medium S, etc., are disposed.

To describe the operation of the image forming apparatus structured as described above, as a sheet feeding signal is outputted from the controlling means (control circuit) (unshown) of the apparatus main assembly 100, the transfer medium S is fed into the apparatus main assembly 100 from one of the pair of cassettes 110 and 111, or the manual feeding tray 112. Meanwhile, the beam of light emitted from a light source 107 toward an original D on the original placement platen 106 and reflected by the original is read by the CCD unit 109, and is converted into a series of electrical signals. Then, the electrical signals are fed into a laser scanner unit 102, which emits a beam of laser light modulated with the series of electrical signals, onto the photosensitive drum 113, which has been charged by the primary charging device 114. As a result, an electrostatic latent image is formed on the photosensitive drum 113. Then, black toner as developer is supplied to the photosensitive drum 113 by the developing device 103. As a result, a toner image of black color, which reflects the pattern of the electrostatic latent image, is formed on the photosensitive drum 113. Then, the toner image on the photosensitive drum 113 is adjusted in potential level by the post-charging device 116, and is moved to the transfer position.

Meanwhile, the transfer medium S fed from the sheet feeding portion 100C is rectified in orientation by the pair of registration rollers 121, and then, is released by the registration rollers 121 with such a timing that the transfer medium S will arrive at the transfer portion, in synchronism with the arrival of the toner image on the photosensitive drum 113 at the transfer portion. Then, as a predetermined transfer bias voltage is applied to the transfer charging device 119, the toner image is transferred from the photosensitive drum 113 onto the transfer medium S.

After the toner image transfer, the transfer medium S is separated from the photosensitive drum 113, and is conveyed to the fixing apparatus 104 by the conveying apparatus 122. In the fixing apparatus 104, the unfixed image on the transfer medium S is permanently fixed to the transfer medium S by the heat and pressure from the fixing apparatus 104. Then, the transfer medium S, to which the image has just been fixed is discharged from the apparatus main assembly 100 by the pair of discharge rollers 105.

As described above, the transfer medium S fed from the sheet feeding portion 100C is discharged after an image is formed on the transfer medium S by the image forming portion 100A, in accordance with the image formation data signals from the original reading portion 100B.

[Powder Conveying Apparatus]

Figure 12:
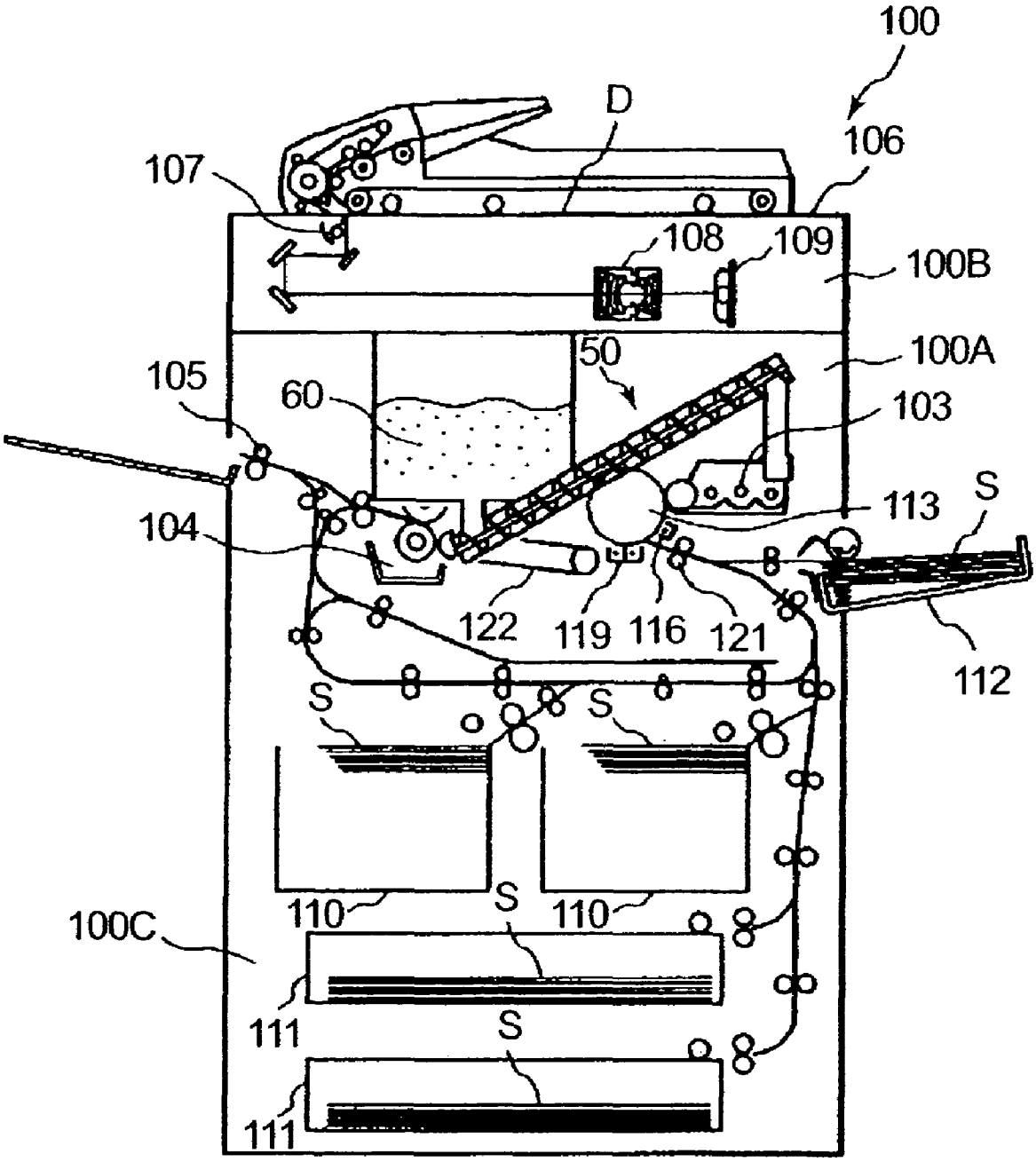
FIG. 12 is a schematic sectional view of the image forming apparatus in FIG. 11, showing the positioning of the diagonal hoist powder conveying apparatus thereof.

Next, referring to FIGS. 12 and 13, the powder conveying apparatus of the image forming apparatus 100, which best characterizes the present invention, will be described.

The developer conveying apparatus 50, as a powder conveying apparatus, in this embodiment is a conveying apparatus of a hoist type which conveys in the diagonally upward direction, developer (single-component toner) as powder to be conveyed. Hence, the developer conveying apparatus 50 in this embodiment will be referred to as diagonal hoist powder conveying apparatus.

To describe in more detail, the diagonal hoist type conveying apparatus 50 comprises a diagonal developer hoisting portion 52 as a tilted powder conveying portion, in the form of a roughly cylindrical pipe, which extends at a predetermined angle relative to the gravity direction, from a developer storage portion 60 (hopper) for temporarily holding the toner from a developer supply container (toner bottle) (unshown), to the developing device 103 in order to supply the developing device 103 with the toner from the toner supply container. In the diagonal hoisting portion 50, a conveyance screw 51 as conveying means is disposed, being supported so that it will rotate roughly about the axial line of the diagonal developer hoisting portion 50. The diagonal hoist developer conveying apparatus 50 is provided with a toner inlet 56, which is open upward of the developer hoisting apparatus 50 to receive the toner from the hopper 60, and a developer outlet 57, which is open downward for the diagonal hoist developer conveying apparatus 50 to supply the developing device 103 with the toner from the hopper 60.

The hopper 60 internally holds the replenishment toner, and releases it into the developer inlet 56 of the developer hoisting apparatus 50 connected to the hopper 60, through the developer outlet 61 located at the bottom of the hopper 60.

Thus, as driving force is transmitted, as necessary, to the toner conveyance screw 51 of the diagonal hoist developer conveying apparatus 50 from the motor (unshown), as a driving means, of the apparatus main assembly 100, the toner in the conveyance pipe 52 is conveyed in the direction indicated by an arrow mark h in the drawing, and eventually, falls into the developer container 203*d* of the developing device 203, through the toner outlet 57, and the developer inlet 103*e*, which is connected to the toner outlet 57.

In this embodiment, the diagonal hoist developer conveying apparatus 50 is structured so that the amount by which toner is supplied to the developing device 103 is controlled by controlling the length of time (number of revolutions) the conveyance screw 51 is driven by the driving means (unshown), in response to the amount by which the developing device 103 is to be supplied with developer, and which is calculated by a controlling means (unshown). The method for calculating the amount by which the developing device 103 is to be supplied with developer, and the method for controlling the driving means, are optional; any method known in the field of this business may be employed.

As described above, in the image forming apparatus 100 in this embodiment, the diagonal hoist developer conveying apparatus 50 is employed to position the hopper 60 and developing device 103 at about the same level in order to reduce the size of the image forming apparatus. More specifically, the above described positioning of the hopper 60 and developing device 103 is very effective to minimize the vertical dimension of the image forming portion 100A in order to increase the number of the sheet feeding cassettes (110 and 111) which can be stacked to increase the sheet capacity of the apparatus, and also, very effective to reduce the size of the image forming apparatus 100 itself.

The above described structural arrangement, however, suffers from the following problems. That is, if the diagonal hoist developer conveying apparatus 50 is employed as a developer conveying apparatus, powder sometimes slips through the clearance between the internal surface 52*a* of the diagonal developer hoisting portion 52 and the peripheral surface (edge) 54*b* of the spiral flange 54, reducing thereby drastically the developer conveyance efficiency, as described above. Further, as the amount of the toner in the hopper 60 reduces, that is, as the toner level H in the hopper 60 reduces, the amount by which toner is supplied to the developing device 103 gradually reduces. These phenomena affect the level of precision at which toner is supplied to the developing device 103, which in turn affects the level of stability at which images can be formed by the apparatus.

Thus, also in the case of the diagonal hoist developer conveying apparatus 50 in this embodiment, an elastic magnetic belt, such as the one in the first embodiment, cut out of a sheet of elastic magnet is pasted to the peripheral edge of the spiral flange of the developer conveyance screw 51.

With the provision of this structural arrangement, even if powder to be conveyed is toner with an extremely small particle diameter, and the diagonal hoist developer conveying apparatus 50, which hoists (conveys upward) the toner at a predetermined angle relative to the gravity direction, is employed as a developer conveying means, it is possible to prevent the problems that the level of precision and level of efficiency, at which developer is conveyed, reduce because powder slips through the clearance between the internal surface 52*a* of the conveyance pipe 52 and the peripheral surface 54*b* of the spiral flange 54 of the conveyance screw 51. Therefore, the problem that toner increases in density in the adjacencies of the developer inlet 56 of the diagonal hoist developer conveying apparatus 50 due to the toner leakage, and is likely to clog the joint between the developer conveying apparatus 50 and developing device 103, does not occur. In other words, the employment of the structure arrangement in this embodiment for the developer hoisting apparatus 50 drastically improves the apparatus 50 in the margin of safety regarding the level of precision and level of efficiency at which developer is conveyed.

Further, with the provision of the above described structural arrangement, it is unnecessary to reduce the clearance between the conveyance screw 51 and the internal surface 52*a* of the conveyance pipe 52 in order to prevent the powder leakage. Therefore, it is possible to reduce the manufacturing cost. Further, even when toner with a low melting point is used, such problems that the toner passage is blocked due to toner agglomeration; the amount of the force for driving the conveyance screw 51 increases; abnormal noises occur; etc., can be prevented.

Further, the conveyance efficiency of the spiral flange 54 of the conveyance screw 51 is drastically improved. Therefore, even if the powder level H in the hopper 60 is lower than the developer inlet 57 of the developer hoisting apparatus 50, toner can be hoisted into the developing device 103 with no problem. In other words, with the employment of the above described structural arrangement, the position of the developer inlet 56 of the developer hoisting apparatus 50 can be lowered compared to that in accordance with the prior art, and the flushing can be prevented. Further, the hopper 60 can be increased in capacity, and the image forming portion 100A can be reduced in vertical dimension to reduce the size of the image forming apparatus.

Further, even if the number of the revolutions per unit of time of the conveyance screw 51 of the diagonal hoist developer conveying apparatus 50 is increased to increase the operational speed of the image forming apparatus, the level of precision and level of efficiency, at which powder is conveyed, are not reduced, and therefore, toner can be reliably conveyed. In other words, even if the image forming apparatus is increased in operation speed, high quality images can be continuously formed.

The developer conveying apparatus in this embodiment, that is, the diagonal hoist developer conveying apparatus 50, is virtually the same in structure as that in the first embodiment, except that in this embodiment, the developer conveyance pipe 52 is tilted. Thus, the distance between the developer inlet 56 and developer outlet 57 is virtually the same as the distance between the developer inlet and developer outlet of the powder conveying apparatus in the first embodiment. Further, the conveyance screw 51, magnetic field generating means 55, rotational speed of the conveyance screw 51, in this embodiment are the same as those in Example 2. As for the angle of the conveyance pipe 52, it is 45 degrees relative to the horizontal direction. The rate at which developer is conveyed per unit of time is 0.57 g/s.

In the experiments carried out to conform the developer conveying performance of the diagonal hoist developer conveying apparatus 50 structured as described above, none of the above described problems, that is, the blocking, abnormal noises, etc., which are attributable to toner agglomeration, occurred, and therefore, toner was conveyed very efficiently and precisely.

Embodiment 3

Next, the powder conveying apparatus in another embodiment of the present invention will be described. In terms of base structure, the powder conveying apparatus in this embodiment is the same as that in the first embodiment. Thus, the elements of the powder conveying apparatus in this embodiment, which are virtually the same in function and structure as those in the first embodiment are given referential symbols comparable to those given to describe the powder conveying apparatus in the first embodiment (same in the number of units, but different in the number of tens), and will not be described in detail. In other words, only the characteristic portions of this embodiment will be described. Further, the powder conveying apparatus in this embodiment is capable of replacing the powder conveying apparatuses of the image forming apparatuses in the first and second embodiments.

Figure 6:
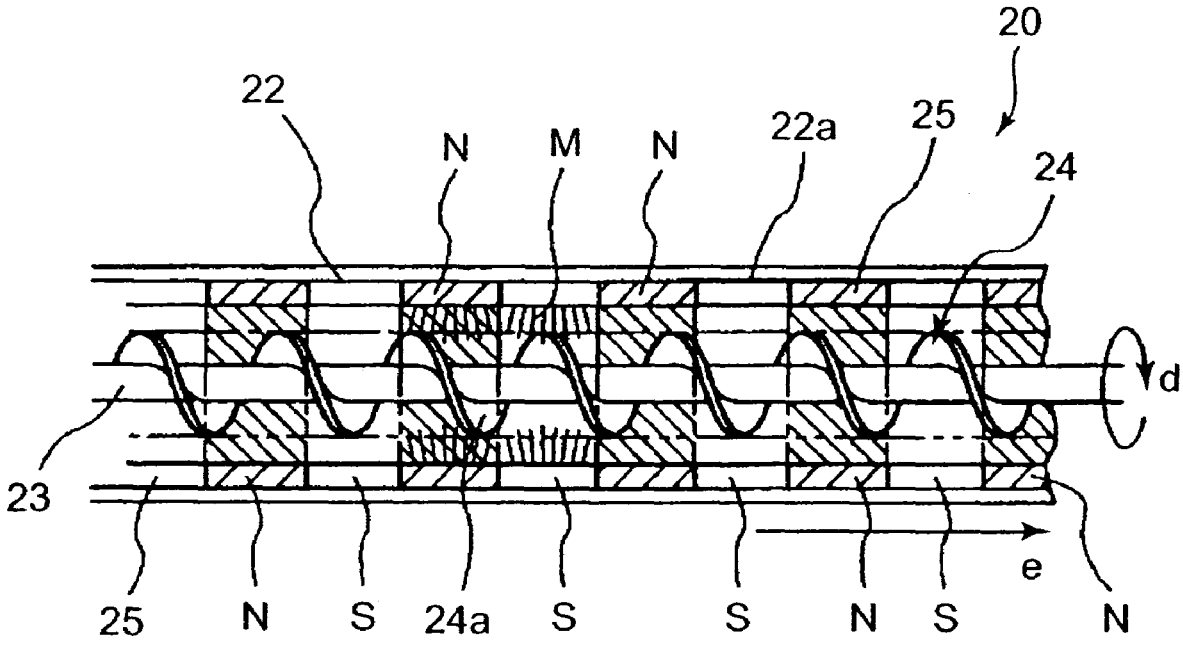
FIG. 6 is a schematic sectional view of another example of the powder conveying apparatus in accordance with the present invention, showing the general structure of the essential portion thereof.

FIG. 6 is a schematic partially sectional view of the powder conveying apparatus 20 in this embodiment, showing the general structure of the essential portions thereof. The powder conveying apparatus 20 comprises a powder conveyance screw 21 as a powder conveying means, and a powder conveyance pipe 22 in which the conveyance screw 21 is disposed.

As the conveyance screw 21 is rotated in the direction indicated by an arrow mark d in the drawing, the powder P to be conveyed is conveyed in the direction indicated by an arrow mark e in the drawing, through the conveyance pipe 22, by the spiral powder conveying surface 24*a* of the spiral flange 24 of the conveyance screw 21.

In this embodiment, the magnetic field generating means 25 is attached to the internal surface 22*a* of the conveyance pipe 22. Thus, the space between the internal surface 22*a* of the conveyance pipe 22 and the peripheral surface 24*b* of the spiral flange 24 of the conveyance screw 21, is kept filled with the magnetic powder M (drawing shows only part of magnetic powder M) retained in the space by the magnetic force of the magnetic field generating means 25 attached to the internal surface 22*a* of the conveyance pipe 22.

More specifically, the gap between the peripheral surface (edge) 24*b* of the spiral flange 24 and the internal surface 22*a* of the conveyance pipe 22 is kept filled with the magnetic powder M by causing the magnetic powder M to crest by the magnetic force of the magnetic field generating means 25. The means for causing the magnetic powder M to crest does not need to be limited to the magnetic field generating means 25. That is, any available means of any configuration may be employed as long as it can magnetically cause the magnetic powder M to crest in a manner to fill the clearance C2 between the peripheral surface 24*b* of the spiral flange 24 and the internal surface 22*a* of the conveyance pipe 22 (in this embodiment, gap between the peripheral surface 24*b* of spiral flange 24 and surface of magnetic field generating means 25).

It is not mandatory that the magnetic field generating means 15 employed by the powder conveying means causes the magnetic powder to crest from one end of the conveyance pipe 22 to the other without any gap. In other words, the magnetic field generating means 15 may be such a means that generates a plurality of magnetic fields, virtually connected to each other, or separated from each other, in terms of the lengthwise direction of the conveyance pipe 22, so that the flux density repeatedly changes between the virtually zero level and maximum level, in terms of the lengthwise direction of the conveyance pipe 22.

Figure 8:
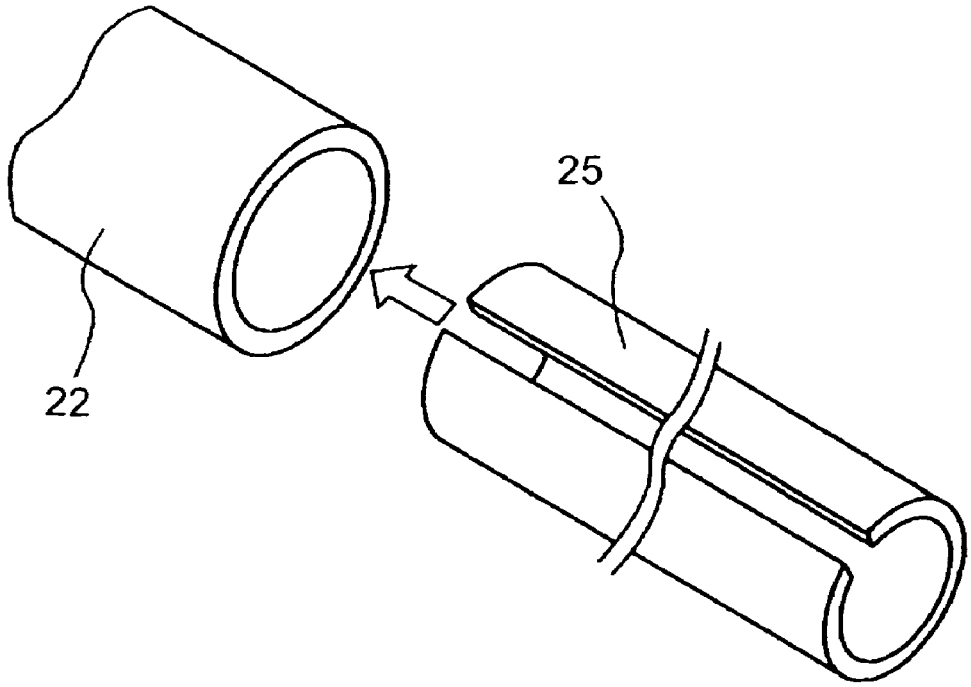
FIG. 8 is a schematic perspective view of the essential portion, that is, the powder conveyance pipe and elastic magnetic sheet, of the powder conveying apparatus in FIG. 6, prior to the assembly thereof, describing the positional relationship between them.
Figure 9:
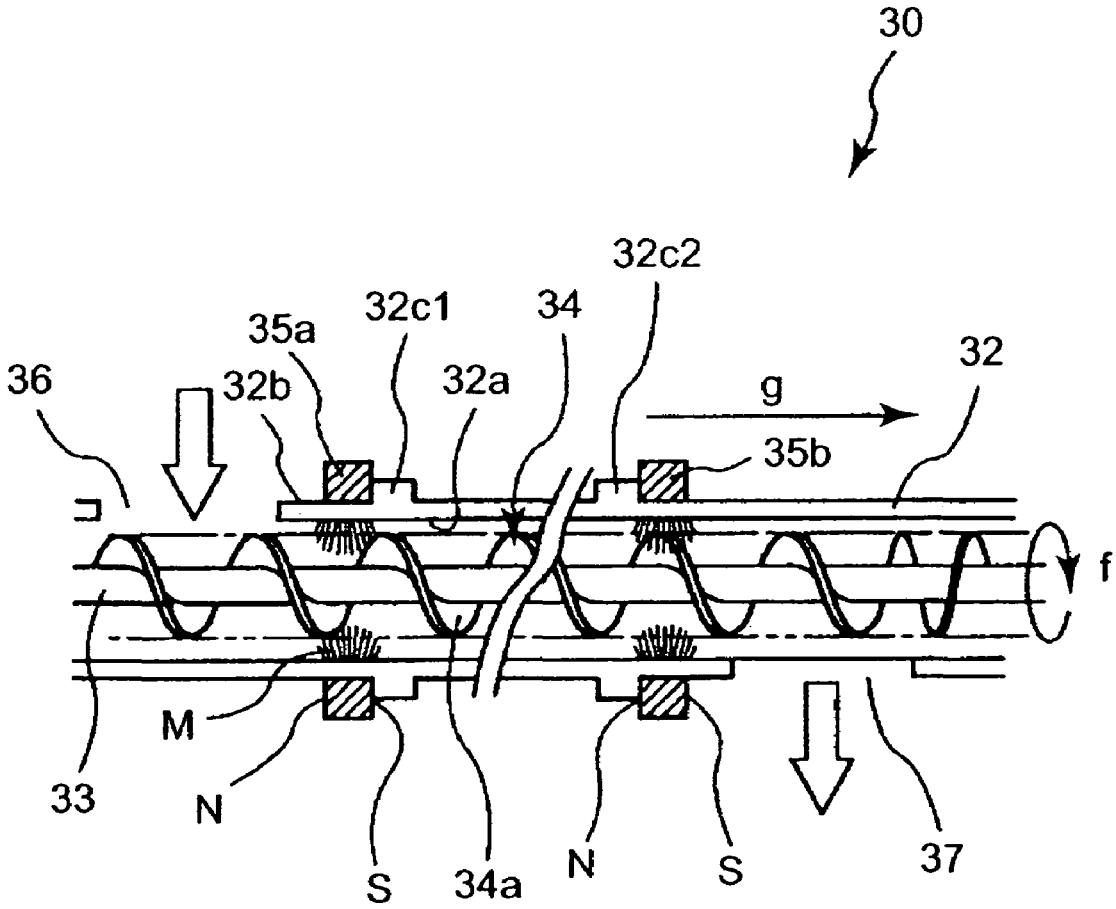
FIG. 9 is a schematic sectional view of another example of the powder conveying apparatus in accordance with the present invention, showing the general structure of the essential portion thereof.
Figure 10:
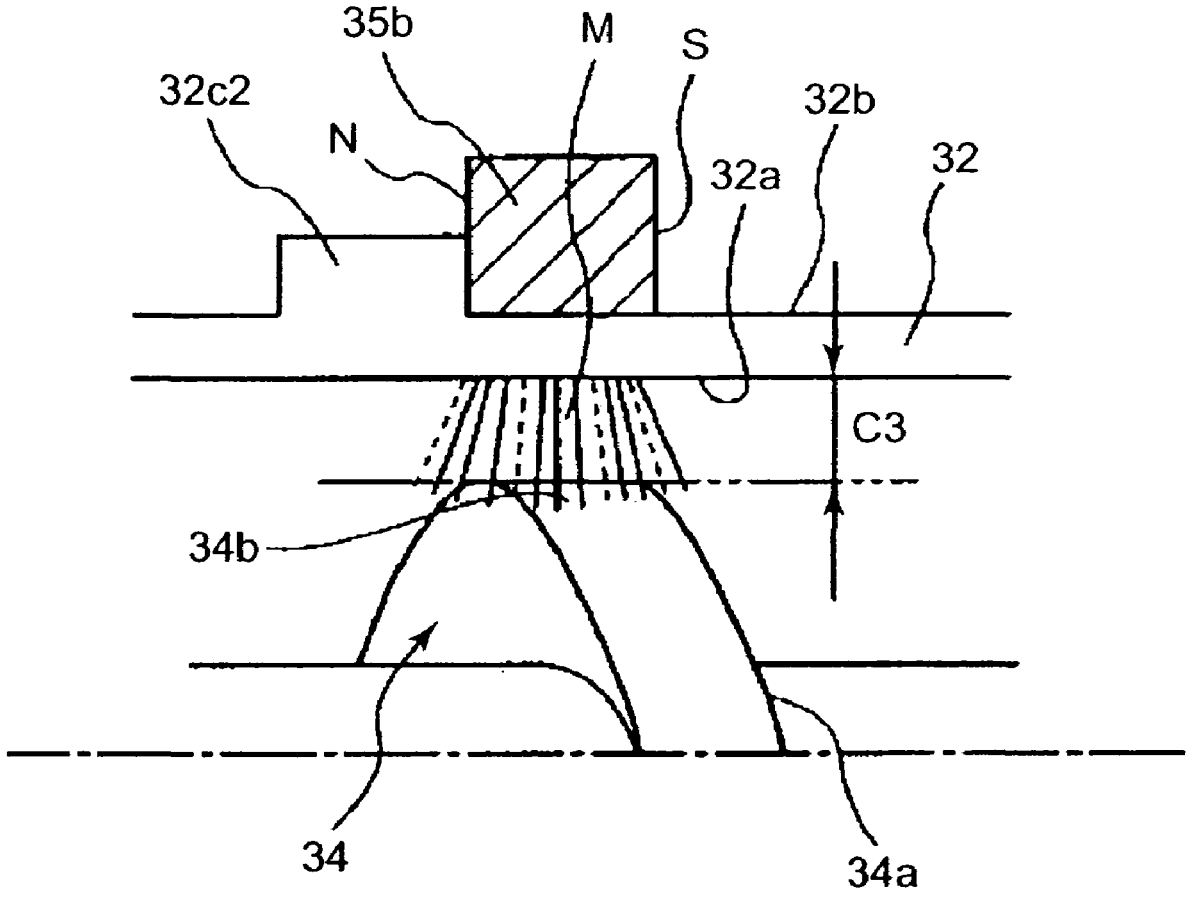
FIG. 10 is an enlarged view of the portion of the powder conveying apparatus, in FIG. 9, essential to the description of the present invention, showing in detail the relationship between the powder conveyance pipe and powder conveyance screw.

In this embodiment, a roughly rectangular sheet of elastic magnet is employed as the elastic magnet 25 in consideration of ease with which the elastic magnets 25 can be attached to the internal surface 22*a* of the conveyance pipe 22. The rectangular sheet of elastic magnet 25 is cylindrically rolled, and securely attached to the internal surface 22*a* of the conveyance pipe 22 with the use of adhesive or the like as a fixing means, in a manner to entirely cover the internal surface 22*a* from one lengthwise end to the other, as shown in FIG. 8.

Figure 7:
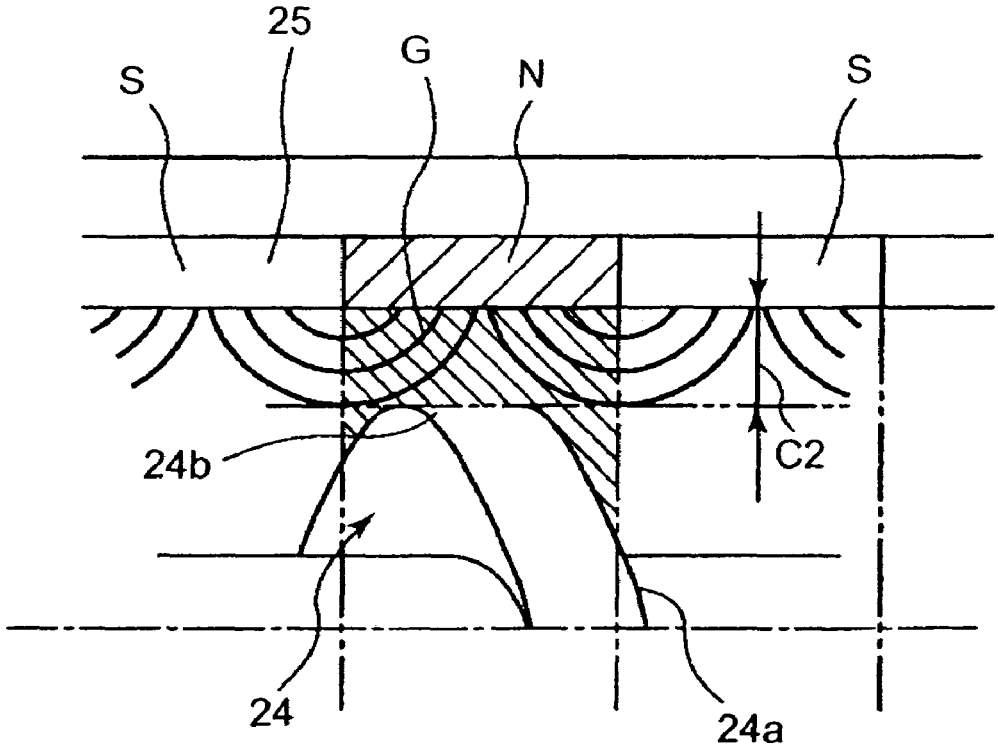
FIG. 7 is an enlarged view of the portion of the powder conveying apparatus, in FIG. 6, essential to the description of the present invention, showing in detail the relationship between the powder conveyance pipe and powder conveyance screw.

FIG. 7 schematically shows the magnetic lines of force of the elastic magnetic sheet 25 in this embodiment. As is evident from the drawing, the roughly rectangular magnetic elastic sheet 25 has a plurality of rectangular N pole areas and a plurality of rectangular S pole areas arranged in parallel so that the N and S pole areas are alternately positioned in terms of the lengthwise direction of the conveyance pipe 22.

In this embodiment, only a single elastic magnetic sheet 25, which is large enough to cover the entirety of the internal surfaces 22*a* of the conveyance pipe 22, in terms of lengthwise direction, as well as circumferential direction is used. However, the number of the elastic magnetic sheet 25 does not need to be limited to one. In other words, a plurality of elastic magnetic sheets (25), which are smaller than the elastic magnetic sheet 25 in this embodiment, in terms of the lengthwise and/or circumferential direction of the conveyance pipe 22, may be employed to cover the entirety of the internal surface 22*a* of the conveyance pipe 22.

In this embodiment, the conveyance screw 21 comprises a shaft 23 and a spiral flange 24, and the elastic magnetic sheet 25 is pasted to the internal surface 22*a* of the conveyance pipe 22.

As for the advantages of this embodiment, the magnetic field generating means is not attached to the peripheral surface (edge) 24*b* of the spiral flange 24 of the conveyance screw 21. Therefore, the shape of the conveyance screw 21 is optional.

Further, the elastic magnetic sheet 25 may be roughly rectangular. Therefore, even when the elastic magnetic sheet 25, the N and S poles of which must be arranged as shown in FIG. 6, is cut out of a larger elastic magnetic sheet, the plurality of parallel rectangular N and S pole areas of which are arranged so that the N and S poles are alternately positioned, the level of precision at which the elastic magnetic sheet 25 is cut out of the larger elastic magnetic sheet does not need to be as high as that required when cutting the elastic magnetic belts in the preceding embodiments. Thus, this embodiment is effective for cost reduction.

Also in this embodiment, the elastic magnetic sheet 25 as a magnetic field generating means is pasted on the internal surface 22*a* of the conveyance pipe 22. Therefore, the magnetic powder M is made to crest roughly perpendicular to the direction e in which the powder P is conveyed. Therefore, the clearance C2 is better sealed by the cresting magnetic powder M, making it possible to convey the powder P at a higher level of precision.

Further, having the magnetic powder M crested roughly perpendicular to the direction e in which the powder P is conveyed offers the benefits that the residual flux density of the elastic magnetic sheet 25 can be set to a smaller value than the value to which that of the elastic magnetic belt 15 in the first embodiment must be set, and also, that the clearance between the internal surface 22*a* of the conveyance pipe 22 and the conveyance screw 21 is allowed to be larger.

In summary, this embodiment offers the benefits that unlike in the first embodiment, the clearance C2 does not need to be reduced the smallest possible proportion in consideration of the powder leakage through the clearance C2, and the magnetic force of the elastic magnetic sheet 25 does not need to be set to as high a value as that in the first embodiment.

In other words, this embodiment also achieves high levels of efficiency and precision in terms of powder conveyance while realizing an astonishing amount of cost savings in consideration of the fact that the powder conveying apparatuses are mass-produced.

The following are the actual specifications of the powder conveying apparatus 20 in this embodiment.

The conveyance pipe 22 of the powder conveying apparatus 20 in this embodiment is identical to the example in the first embodiment. The conveyance screw 21 in this embodiment is the same as that in Example 1, except that the peripheral surface 24*b* of the spiral flange 24 is not provided with the groove for the elastic magnetic belt. Further, the magnetic powder M, powder P to be conveyed, conveyance screw revolution per unit of time, in this embodiment are the same as those in Example 1.

Elastic magnetic sheet 25
material: rubber-ferrite magnet
internal surface length (conveyance pipe length): 142 mm
width (circumferential direction of conveyance pipe): 44 mm thickness: 1.0 mm
residual flux density: 150 mT
length of N (S) pole in lengthwise direction of conveyance pipe: 3 mm (pitch)
Clearance C2
1.0 mm In the case of the powder conveying apparatus in this embodiment structured as described above, excellent powder conveyance performance was achieved when the residual flux density of the elastic magnetic sheet 25 and clearance C2 were set to typical values of 150 mT and 1.0 mm, respectively.

The various experiments carried out by the inventors of the present invention revealed the following. That is, in the case of the powder conveying apparatus structure in which the elastic magnetic sheet 25 as a magnetic field generating means is attached to the internal surface 22*a* of the conveyance pipe 22 in order to make the magnetic powder M crest roughly perpendicular to the direction in which powder P (object to be conveyed) is conveyed, it is desired that the residual flux density of the elastic magnetic sheet 25 is set to a value within the range of 50 mT–250 mT, and that the clearance C2 is set to a value within the range of 0.5 mm–2.0 mm. If they are set to values outside these ranges, there is the possibility that the problems mentioned in the description of the first embodiment might occur.

The value, given above, of the magnetic force, that is, the residual flux density, of the magnetic field generating means was obtained by measuring the magnetic force using a properly calibrated instrument before the pasting of the elastic magnetic sheet 25.

As described above, in this embodiment, the magnetic powder M is adhered to the elastic magnetic sheet 25 pasted to the internal surface 22*a* of the conveyance pipe 22. The effects of this arrangement are the same as those (i)–(iv) achieved by the preceding embodiments. In addition, this embodiment offers the following benefits: (1) more latitude is afforded in determining the configuration of the conveyance screw 21; (2) the level of precision at which the elastic magnetic sheet 25 is cut out of a larger elastic magnetic sheet does not need to be as high as that required when cutting out the elastic magnetic belts in the preceding embodiments; (3) the magnetic powder M is made to crest roughly perpendicular the direction e in which the powder P is conveyed, and therefore, high levels of efficiency and precision in terms of powder conveyance are realized; and (4) the residual flux density of the elastic magnetic sheet 25 and the clearance C2 can be set to values smaller than those in the preceding embodiments, and therefore, cost can be reduced.

As will be evident from the above descriptions of the preceding embodiments, the present invention was described with reference to several preferred embodiments of the present invention. However, it should be understood that these embodiments are not intended to limit the scope of the present invention. In other words, it should be understood that the powder conveying apparatus structures easily traceable to the gist of the present invention disclosed in this specification of the present invention fall within the scope of the present invention.

As described above, according to the present invention, it is unnecessary to reduce the clearance between the developer conveying pipe and developer conveying screw to the smallest possible proportion in order to prevent the problem that as developer suddenly pours into the developer conveying apparatus, the developer accidentally leaks through the clearance. Thus, it is possible to accomplish both the reduction in the level of precision required for manufacturing the developer conveying apparatus, and the reduction in the cost of the developer conveying apparatus.

Further, it is possible to prevent the problem that developer accidentally leaks through the above described clearance due to the shocks which occur as the rotation of the rotary of a rotary developing apparatus is stopped, without adversely affecting the developer conveyance performance of the developer conveying apparatus.

In other words, it is possible to prevent developer from agglomerating into coarse developer, while preventing the level of efficiency and the rate (amount per unit of time), at which developer is conveyed, from falling.

Therefore, it is possible to prevent the formation of defective images while achieving a high level of productivity.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

a developing device for developing an electrostatic image formed on an image bearing member with a magnetic developer;

a supply tube for supplying the magnetic developer into said developing device;

a feeding screw for feeding the magnetic developer in said supply tube; and a magnetic member for confining the magnetic developer in a clearance between said supply tube and said feeding screw, wherein said magnetic member is provided at a substantially radially outermost portion of said feeding screw.

2. An apparatus according to claim 1, wherein said magnetic member is provided to correspond to at least one pitch of said feeding screw adjacent an outlet of said supply tube.

3. An apparatus according to claim 2, wherein said magnetic member has N magnetic poles and S magnetic poles which are alternately arranged along the substantially radially outermost portion of said feeding screw.

4. An apparatus according to claim 3, wherein a magnetic flux density of said magnetic member is 100 mT–500 mT, and the clearance is 0.5 mm–1.5 mm.

5. An apparatus according to claim 1, wherein said magnetic member is mounted to a recess formed in the substantially radially outermost portion of said feeding screw.

6. An apparatus according to claim 1, further comprising a developer supply container, which can communicate with said supply tube, for supplying the magnetic developer.

7. An apparatus according to claim 1, further comprising a rotatable member supporting a plurality of sets of said developing device, said supply tube and said feeding screw, wherein said rotatable member places a selected one of said developing devices at a developing position.

8. An apparatus according to claim 1, wherein the magnetic developer has non-magnetic toner and magnetic carrier.

* * * * *